US007069991B2

(12) United States Patent
Gudmestad et al.

(10) Patent No.: US 7,069,991 B2
(45) Date of Patent: Jul. 4, 2006

(54) METHOD AND APPARATUS FOR SURGE PRESSURE REDUCTION IN A TOOL WITH FLUID MOTIVATOR

(75) Inventors: Tarald Gudmestad, Houston, TX (US); Mark J. Murray, Sugar Land, TX (US)

(73) Assignee: Weatherford/Lamb, Inc., Houston, TX (US)

( * ) Notice: Subject to any disclaimer, the term of this patent is extended or adjusted under 35 U.S.C. 154(b) by 180 days.

(21) Appl. No.: 10/339,367

(22) Filed: Jan. 9, 2003

(65) Prior Publication Data

US 2004/0134664 A1 Jul. 15, 2004

(51) Int. Cl.
*E21B 33/00* (2006.01)

(52) U.S. Cl. ..... 166/285; 166/70; 166/117.4; 166/386

(58) Field of Classification Search ..... 166/285, 166/381, 386, 177.4, 105, 70
See application file for complete search history.

(56) References Cited

U.S. PATENT DOCUMENTS

| | | | | |
|---|---|---|---|---|
| 4,796,704 A | | 1/1989 | Forrest et al. | |
| 5,960,881 A | | 10/1999 | Allamon et al. | 166/291 |
| 6,053,261 A | | 4/2000 | Walter | |
| 6,182,766 B1 | | 2/2001 | Rogers et al. | 166/386 |
| 6,401,822 B1 | | 6/2002 | Baugh | |
| 6,571,869 B1 | * | 6/2003 | Pluchek et al. | 166/177.4 |
| 2003/0024706 A1 | * | 2/2003 | Allamon | 166/373 |
| 2003/0146001 A1 | * | 8/2003 | Hosie et al. | 166/369 |
| 2003/0221837 A1 | * | 12/2003 | Giroux et al. | 166/373 |
| 2004/0069501 A1 | * | 4/2004 | Haugen et al. | 166/381 |

FOREIGN PATENT DOCUMENTS

WO WO 01/69036 9/2001

OTHER PUBLICATIONS

U.K. Search Report, Application No. GB0400359.6, dated Apr. 30, 2004.

* cited by examiner

*Primary Examiner*—William Neuder
(74) *Attorney, Agent, or Firm*—Moser, Patterson & Sheridan, L.L.P.

(57) ABSTRACT

Apparatus and method for controlling pressure surges in a wellbore. One embodiment provides a downhole surge control tool equipped with a fluid motivator. The fluid motivator may be, for example, any type of motor or a venturi. The fluid motivator motivates wellbore fluid through a bypass channel formed in the tool and then out an exhaust port of the tool.

57 Claims, 16 Drawing Sheets

METHOD AND APPARATUS FOR SURGE PRESSURE REDUCTION IN A TOOL WITH FLUID MOTIVATOR

BACKGROUND OF THE INVENTION

1. Field of the Invention

The present invention generally relates to an apparatus and a method for reducing downhole surge pressure, for example, while running a liner into a wellbore. More particularly, the invention relates to an apparatus and a method for reducing surge pressure by actively motivating fluid flow through a tool and into an annulus exterior to the tool.

2. Description of the Related Art

Running tools are used for various purposes during well drilling and completion operations. For example, a running tool is typically used to set a liner hanger in a well bore. The running tool is made up in the drill pipe or tubing string between the liner hanger and the drill pipe or tubing string running to the surface. In one aspect, the running tool serves as a link to transmit torque to the liner hanger to help place and secure the liner in the well bore. In addition, the tool also provides a conduit for fluids such as hydraulic fluids, cement and the like. Upon positioning of the liner hanger at a desired location in the well bore, the running tool is manipulated from the surface to effect release of the liner hanger from the running tool. The liner may then optionally be cemented into place in the well bore. In some cases, the cement is provided to the well bore before releasing the liner.

One problem with running tools occurs when lowering a liner hanger, for example, at a relatively rapid speed in drilling fluid. The rapid lowering of the liner hanger results in a corresponding increase or surge in the pressure generated by the fluids below the liner string. A liner hanger being lowered in to a wellbore can be analogized to a tight fitting plunger being pushed into a tubular housing. The small annular clearance between the liner and the wellbore restricts the rate at which fluid can flow though the clearance. The faster the liner is lowered, the greater the resulting pressure or surge below the liner.

The problems associated with surge pressure are exasperated when running tight clearance liners or other apparatus in the existing casing. For example, clearances between a typical liner's Outer Diameter (O.D.) and a casing's Inner Diameter (I.D.) are ½" to ¼". The reduced annular area in these tight clearance liner runs results in correspondingly higher surge pressures and heightened concerns over their resulting detrimental effects.

The surge pressure resulting from running a liner/casing into a wellbore has many detrimental effects. Some of these detrimental effects include 1) lost volume of drilling fluid; 2) resultant weakening and/or fracturing of the formation when the surge pressure in the wellbore exceeds the formation fracture pressure, particularly in highly permeable formations; 3) loss of cement to the formation during the cementing of the liner in the wellbore due to the weakened and, possibly, fractured formations which result from the surge pressure on those formations; and 4) differential sticking of the drill string or liner being run into a formation during oil-well operations (that is, when the surge pressure in the wellbore is higher than the formation fracture pressure, the loss of drilling fluid to the formation allows the drill string or liner to be pulled against the permeable formation downhole, thereby causing the drill string or liner to "stick" to the permeable formation).

Typically, surge pressures are minimized by decreasing the running speed of the drill string or liner downhole to maintain the surge pressures at acceptable levels. An acceptable level is where the drilling fluid pressure, including the surge pressure, is less than the formation fracture pressure. However, decreasing running speed increases the time required to complete the liner placement, resulting in a potentially substantial economic loss.

Existing solutions to the surge pressure problem are passive in nature. In one embodiment, fluid is permitted to flow into the liner/casing and then up to the surface of the wellbore via the drill pipe. This approach is undesirable because the pressure drop through the drill pipe from the top of the liner/casing to the surface is significant, and the surge pressure below the liner/casing will still limit the run-in speed in many cases. An additional drawback is that the fluid must then be returned to the wellbore by means of some pumping facility. Another approach allows fluid flow from the interior of the liner/casing back into the wellbore via an opening formed in a tool configured as a part of the drill pipe just above the liner/casing. Such approaches are termed "passive" in that fluid flow is motivated by the lowering of the liner and associated drill pipe or tubing string. Accordingly, a surge pressure is still present and, in fact, is required to motivate fluid flow. Further, even though the pressure is being relieved, the surge pressure still increases with increasing running speeds.

Therefore, a surge reduction/elimination tool is needed which allows greater control over the surge pressure.

SUMMARY OF THE INVENTION

The present invention relates to a downhole tool and methods of operating the same. More specifically, the invention relates to an apparatus and a method for controlling surge pressure in a wellbore. In one aspect, a tool of the invention is made up as part of a tubular string. For example, the tool may be disposed at an upper end of a running tool which carries a liner to be cemented in a wellbore.

One embodiment provides for a downhole surge control tool defining an exhaust port for venting fluid. The tool comprises a body having (i) a first opening at a first end, (ii) a second opening at a second end and (iii) defining a bore traversing the tool to fluidly couple the first opening and the second opening; a wellbore fluid bypass path defined between the first opening and the exhaust port; and a fluid motivator to motivate fluid flow through the bypass fluid path and out through the exhaust port. In one embodiment, the fluid motivator may be a selected from a variety of devices including a Venturi jet comprising a nozzle, a mechanical pump (e.g., a centrifugal pump), and an electric pump. In a particular embodiment, the fluid motivator includes a first pump to provide a pressurized jet stream to a Venturi positioned proximate the bypass fluid path, whereby the Venturi produces a suction to motivate fluid flow from the first opening, through the bypass fluid path and out through the exhaust port.

Another embodiment provides a downhole surge control tool comprising a body having a first opening at a first end and a second opening at a second end and defining a bore traversing the tool to fluidly couple the first opening and the second opening. A valve is disposed in the bore and positionable in at least (i) a closed position to at least restrict fluid flow between the first opening and the second opening via the bore and (ii) an open position to allow fluid flow between the first opening and the second opening via the bore. A sealable fluid bypass path is defined between the first opening and an exhaust port formed in the body and a pump is oriented into at least a portion of the fluid bypass path.

Yet another embodiment provides a downhole surge control tool comprising a body having a first opening at a first end and a second opening at a second end and defining a bore traversing the tool to fluidly couple the first opening and the second opening. A valve is disposed in the bore and positionable in at least (i) a closed position to at least restrict fluid flow between the first opening and the second opening via the bore and (ii) an open position to allow fluid flow between the first opening and the second opening via the bore. A sealable fluid bypass path is defined between the first opening and an exhaust port formed in the body and a pump is oriented into at least a portion of the fluid bypass path A sealing member disposed in a cavity of the body is positionable in a closed position to seal the fluid bypass path and an open position to open the fluid bypass path. A collet sleeve is axially slidably disposed with respect to the body and comprises a plurality of collet fingers and one or more connecting members connecting the collet sleeve to the sealing member.

Still another embodiment provides a method of controlling surge pressure downhole, comprising providing a downhole surge control tool comprising a body defining a bore and a valve disposed in the bore and positionable in (i) a closed position to seal the bore and at least restrict fluid flow therethrough and (ii) an open position to unseal the bore. While the valve is in the closed position a motive fluid is flowed through a pump which operates to create a suction pressure. The suction pressure at least partially motivates flow of a wellbore fluid through a fluid bypass path formed in the surge control tool.

BRIEF DESCRIPTION OF THE DRAWINGS

So that the manner in which the above recited features of the present invention are attained and can be understood in detail, a more particular description of the invention, briefly summarized above, may be had by reference to the embodiments thereof which are illustrated in the appended drawings. It is to be noted, however, that the appended drawings illustrate only typical embodiments of this invention and are not to be considered limiting of its scope, for the invention may admit to other equally effective embodiments.

DETAILED DESCRIPTION OF THE PREFERRED EMBODIMENT

Figure 1:
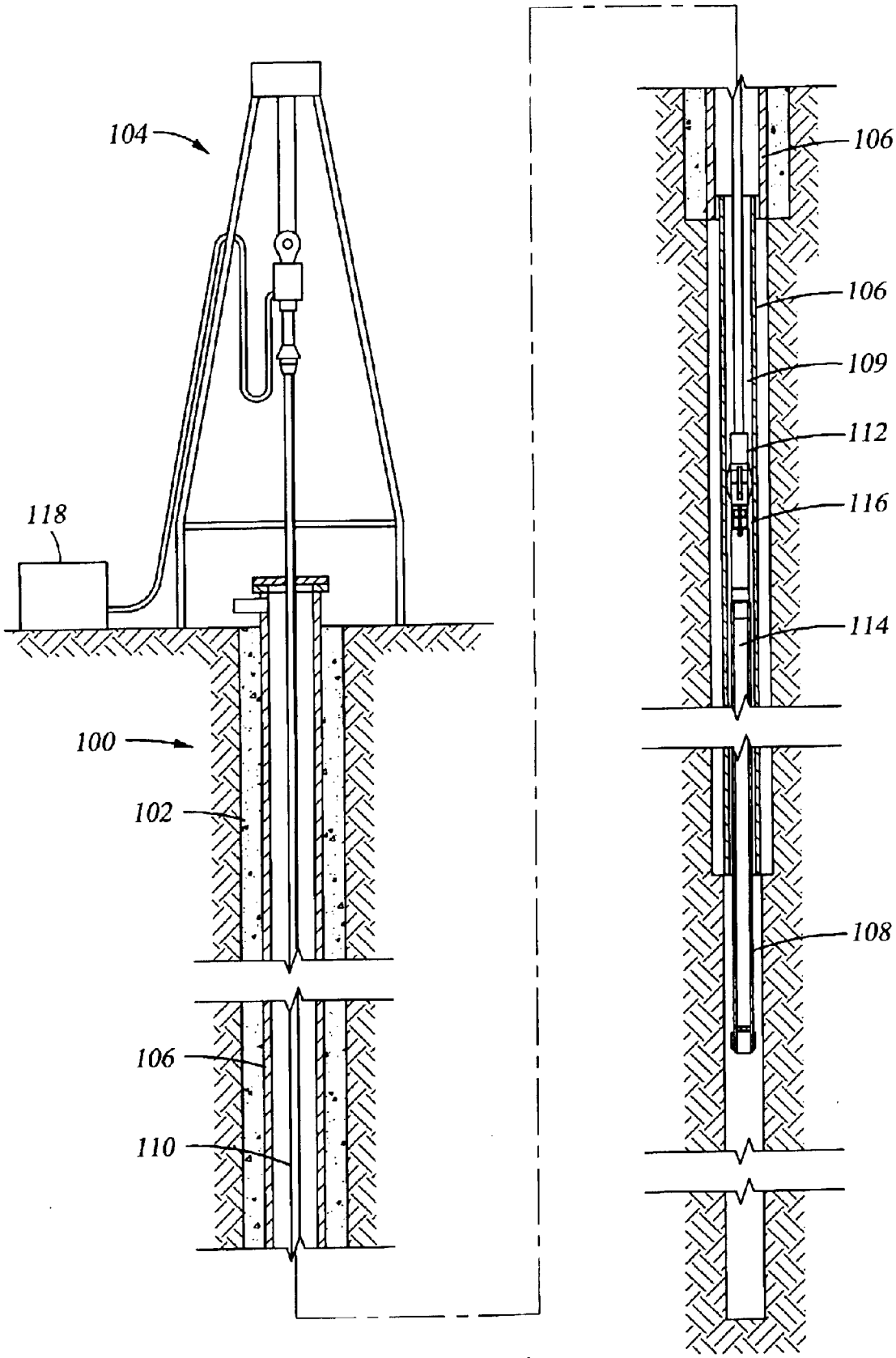
FIG. 1 is an elevation view of the present invention schematically showing the circulation tool described herein located within a representative borehole.

FIG. 1 is a cross-sectional view of a typical subterranean hydrocarbon well 100 which defines a vertical wellbore 102. In addition to the vertical wellbore 102, the well 100 may include a horizontal wellbore (not shown) to more completely and effectively reach formations bearing oil or other hydrocarbons. During or after formation of the wellbore 102, a series of liners are placed in therein to makeup the casing 106. The liners 108 (one shown) are lowered into the wellbore 102 by a working string 110, which is secured to a rig 104. In the present embodiment, the working string 110 includes a surge control tool 112 connected to a liner running tool 114. The liner running tool 114 carries the liner 108. The surge control tool 112 operates to reduce or substantially eliminate the presence of a surge pressure by motivating fluid flow from a central bore 109 of the liner 108, through the liner running tool 114, through the surge control tool 112 and into the annulus 116 formed between the tool 112 and the casing 106. Fluid flow is motivated in this manner by the provision of a pump disposed in the tool 112. The pump is activated by flowing fluid from a pumping facility 118 (located at the surface of the wellbore 102, e.g., with the rig 104), into the tool 112 and then out of the tool 112 and into the annulus 116. In one embodiment, a negative surge pressure may be established, as will be described in more detail below. In some cases, the provision of a negative surge pressure may cause a degree of propulsion of the tool 112 through the wellbore 102.

By way of illustration only, the pump onboard the tool 112 will be described as a Venturi type pump. However, more generally, the pump may be any device or arrangement capable of motivating fluid flow through the tool 112 and out into the annulus 116. Examples of other pumps include mechanical pumps (e.g., centrifugal pumps), electrical pumps and the like. In the case of a mechanical pump and a Venturi pump, the pump is operated by the surface-located pumping facility 118. In the case of an electrical pump, the pump is operated by, for example, an onboard power supply (e.g., a battery) or by a surface-located power supply.

Figure 2A:
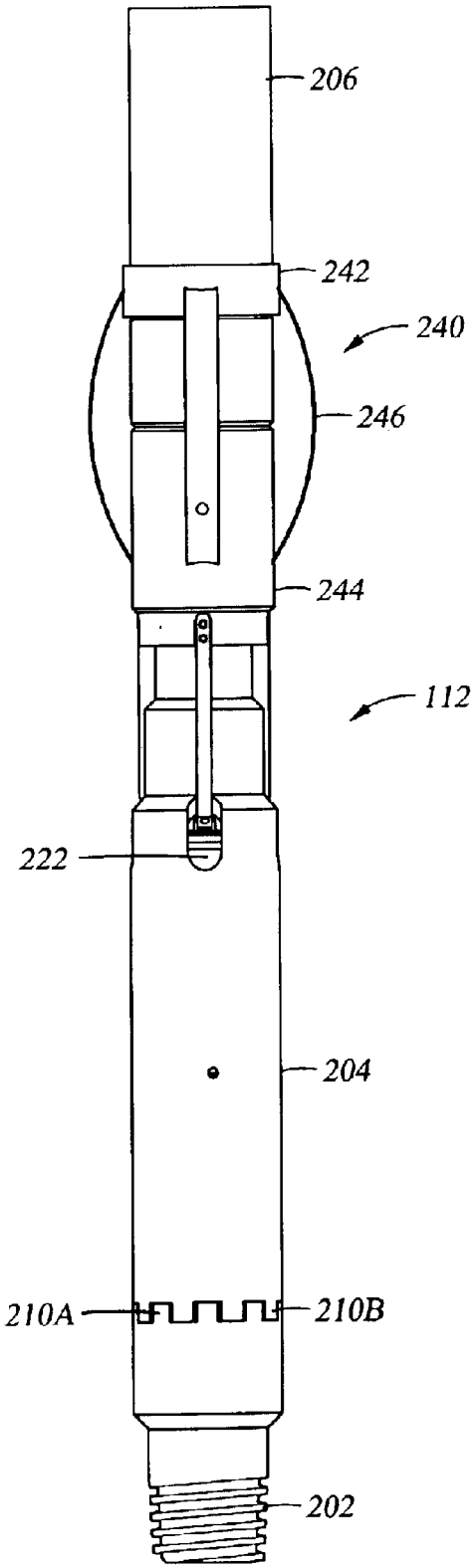
FIG. 2A is an elevation view of a surge control tool, prior to make-up, in a valve closed position (run in position).
Figure 2B:
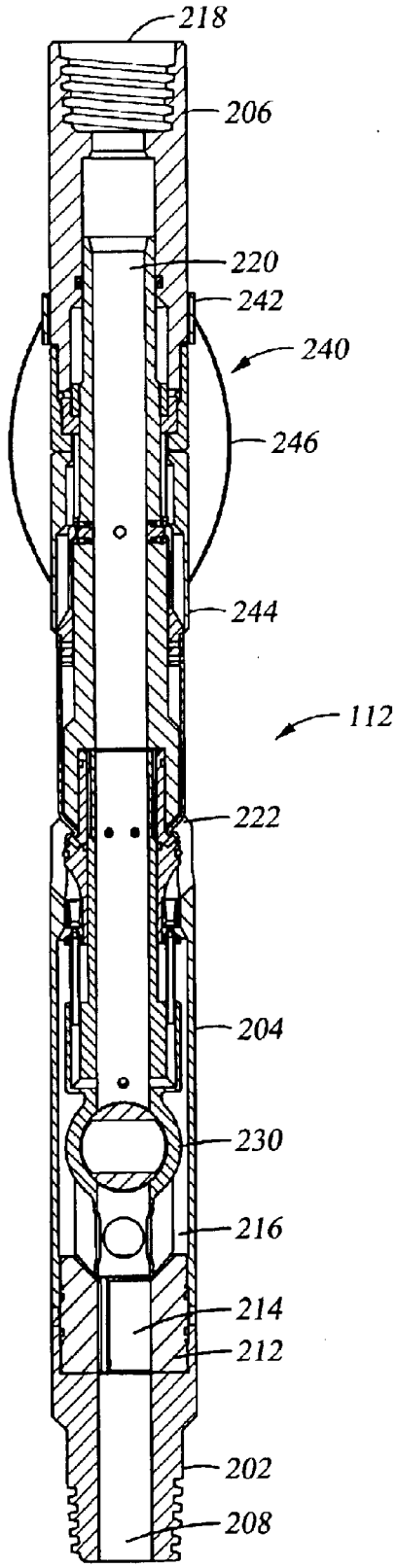
FIG. 2B is a partial cross sectional view of the surge control tool, prior to make-up, in a valve closed position (run in position).
Figure 3A:
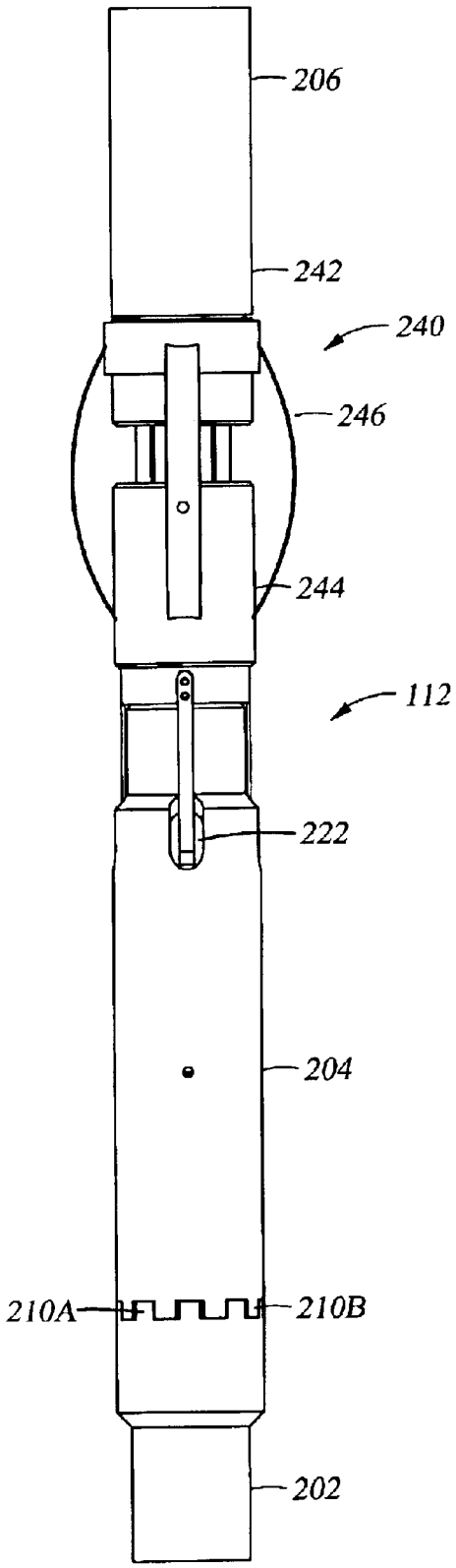
FIG. 3A is an elevation view of the surge control tool, prior to make-up, in a valve open position.
Figure 3B:
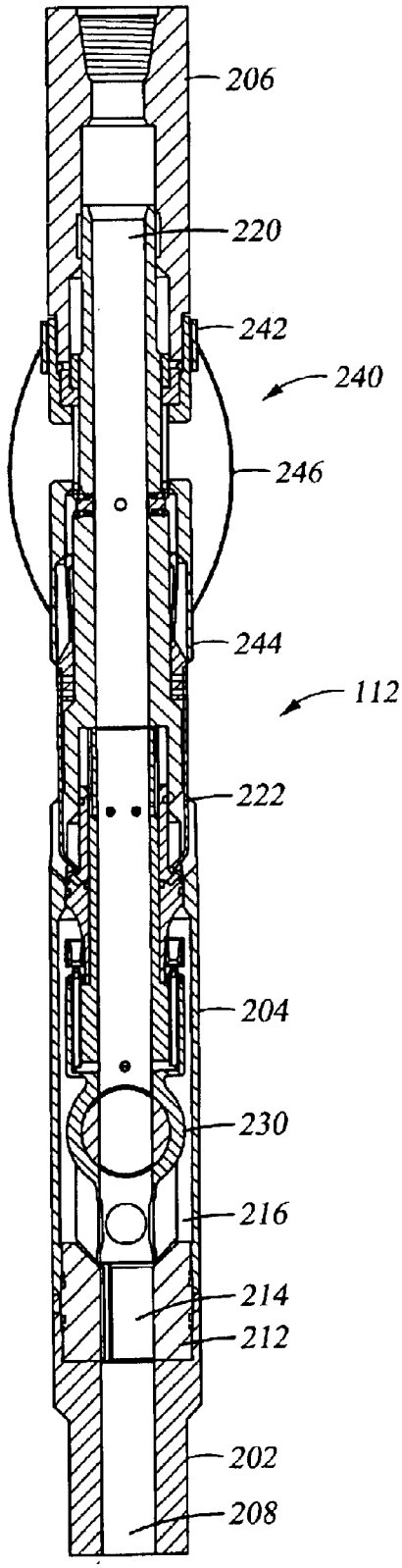
FIG. 3B is a partial cross sectional view of the surge control tool, prior to make-up, in a valve open position.

FIGS. 2A and 2B are an elevation view and a section view, respectively, of the surge-reduction tool 112 prior to make-up and in a run in position (also referred to herein as a "valve closed position"). In contrast, FIGS. 3A and 3B show an elevation view and a section view, respectively, of the surge-reduction tool 112 prior to make-up in an actuated position (also referred to herein as a "valve open position"). As shown, the tool 112 generally comprises a lower sub 202, a housing 204 and an upper body 206.

The upper body 206 is slidably disposed on upper portion of the housing 204. The upper body 206 defines an upper inlet bore 218 which is in fluid communication with a housing bore 220 formed in the upper end of the housing 204. In one aspect, the upper body 206 is adapted for connection to, or is part of, a drill pipe (e.g., the working string 110 shown in FIG. 1).

The lower sub 202 may be connected to a liner to be positioned in the wellbore (FIG. 1) by means of a liner running tool 114. In such a configuration, a lower inlet bore 208 defined by the lower sub 202 may be fluidly communicable with a bore formed in the attached liner (and/or other components attached to the lower sub 202). Accordingly, as the tool 112 is run into the wellbore, fluid entering the lower end of the liner (for example) from the wellbore flows through the liner and into the lower inlet bore 208. As will be described in more detail below, in the run in position (FIGS. 2A–B) the tool 112 provides a flow path allowing the fluid to flow though a portion of the tool 112 and then out into the annulus (the volume between the tool and the inner diameter of the wellbore or casing).

The lower sub 202 and a housing 204 interface at castellations 210A, 210B carried on their respective ends. The castellations allow a torque load placed on the housing 204 to be transmitted to the lower sub 202. The lower sub 202 and a housing 204 are coupled together by a connector 212, which is threadedly secured to each of the lower sub 202 and the housing 204. The connector 212 forms a central opening 214, which is registered with the lower inlet bore 208, and provides a fluid passageway into a cavity 216 of the housing 204. As will be described in more detail below, the cavity 216 selectively accommodates fluid flow from the lower inlet bore 208 out through one or more exhaust ports 222 (illustratively four) formed in the housing 204.

Figure 4:
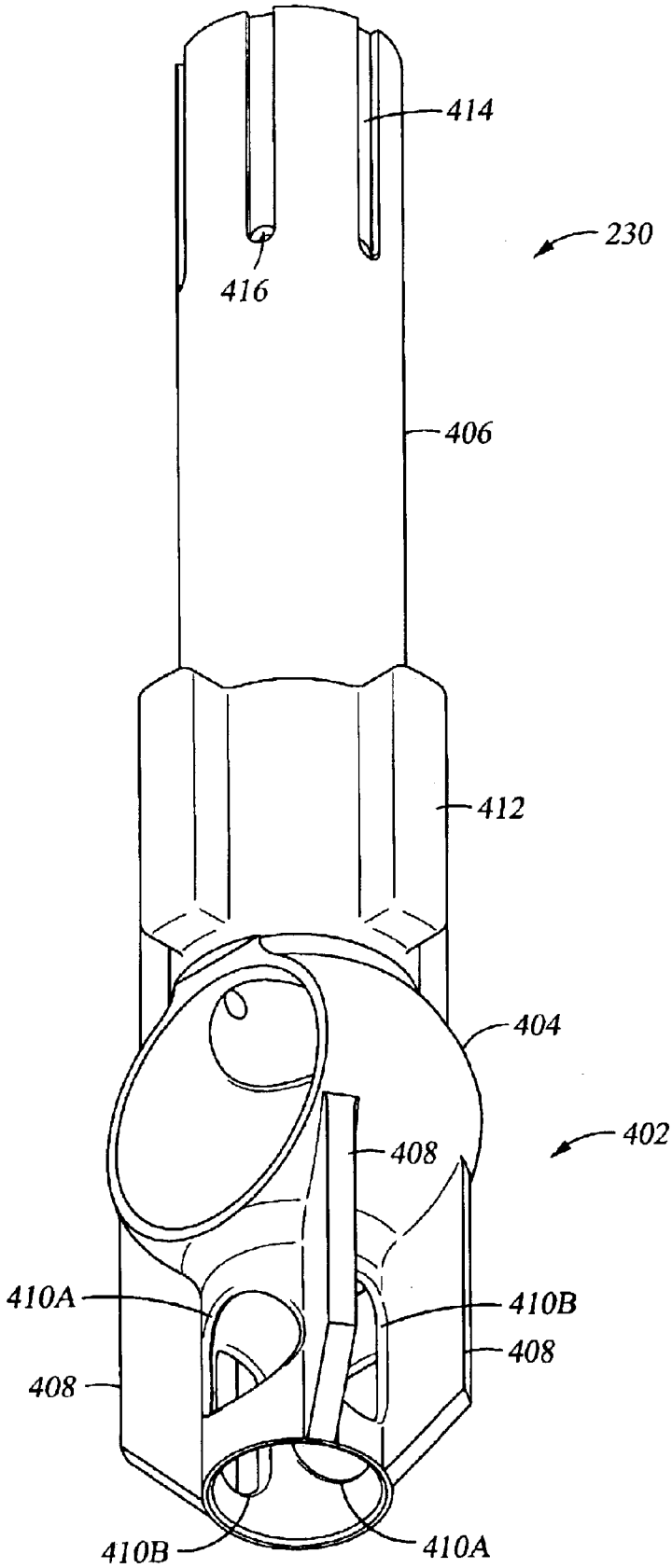
FIG. 4 is an elevation view of an inner sleeve which includes Venturi housings and a valve housing.

As can be seen in FIG. 2B, an inner sleeve 230 is disposed in the cavity 216 adjacent the connector 212. Referring briefly to the perspective view of the inner sleeve 230 shown in FIG. 4, the inner sleeve 230 generally comprises a bypass portion 402, a tubular portion 406 and a valve housing 404 disposed between the bypass portion 402 and the tubular portion 406. The bypass portion 402 generally comprises a plurality of fins 408 and a plurality of bypass ports 410A–B (collectively referred to as bypass ports 410). Illustratively, the bypass portion 402 is shown with four of each of the fins 408 and bypass ports 410. A bypass port 410 is formed on either side of each fin 408. In the illustrative embodiment, two sets of the bypass ports are shown, each with a different geometric shape. Specifically, one bypass ports set 410A has a circular shape and another set 410B has an elliptical shape. Further, the fins disposed on either side of the elliptically shaped bypass ports 410B are spaced more closely to one another then are the fins disposed on either side of the circular shape bypass ports 410A. However, the illustrative configuration is merely illustrative of one embodiment and not limited thereto.

The tubular portion 406 of the inner sleeve 230 carries a plurality of Venturi housings 412. Illustratively, four Venturi housings 412 equally spaced from one another are shown. However, the inner sleeve 230 may be equipped with any number of Venturi housings 412. In addition, a plurality of linear grooves 414 are formed at one end of the tubular portion 406. The grooves 414 extend from a terminal end of the tubular portion 406 and each terminate over respective holes 416 formed in the tubular portion 406. In the illustrative embodiment, six grooves 414 and respective holes 416 are formed in the tubular portion 406. Again, these and each of the other features of the inner sleeve 230 are illustrative. Persons skilled in the art will recognize other embodiments within the scope of the invention.

Figure 5A:
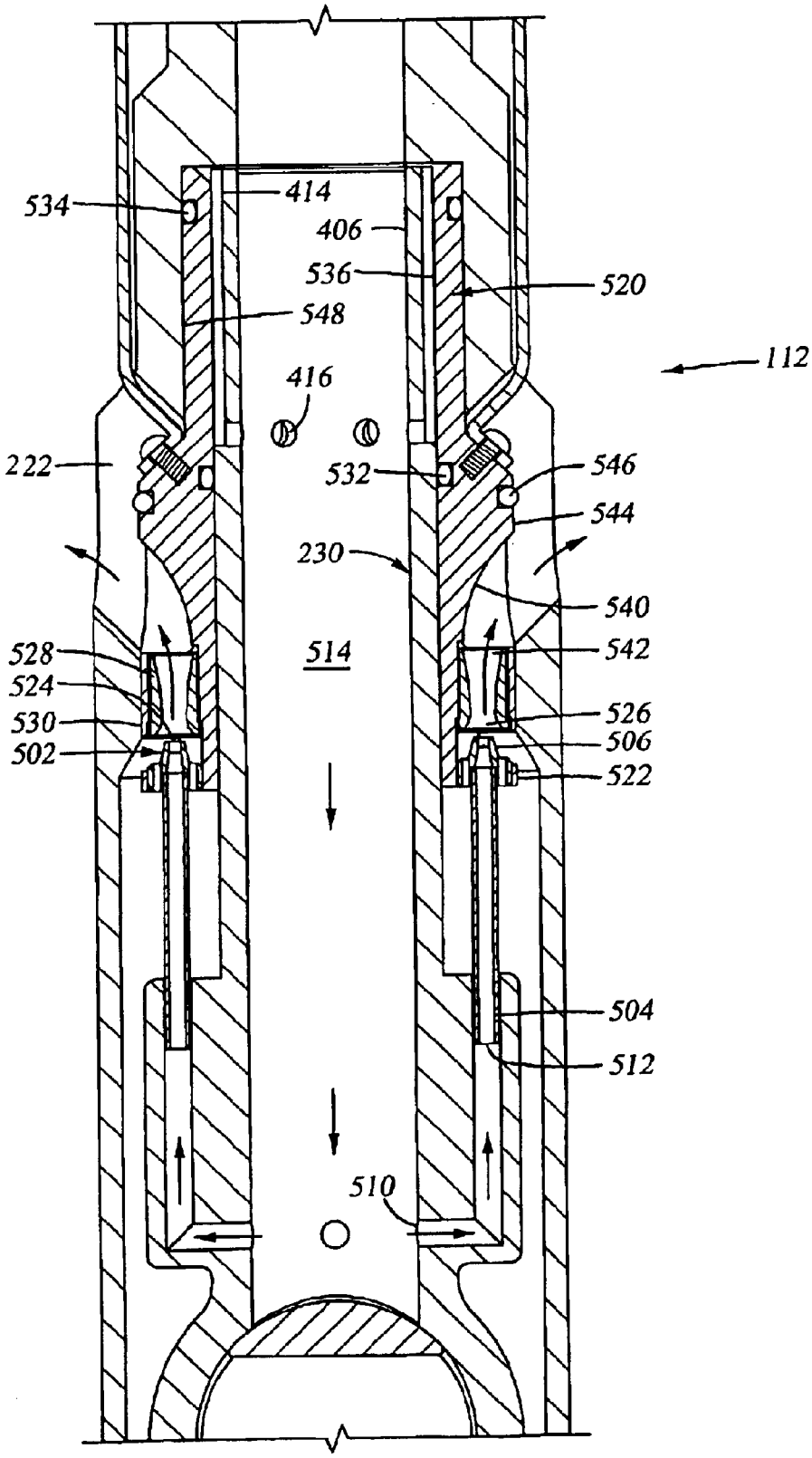
FIG. 5A is a partial cross sectional view of the surge control tool in a run-in position showing aspects of a Venturi jet system.
Figure 5B:
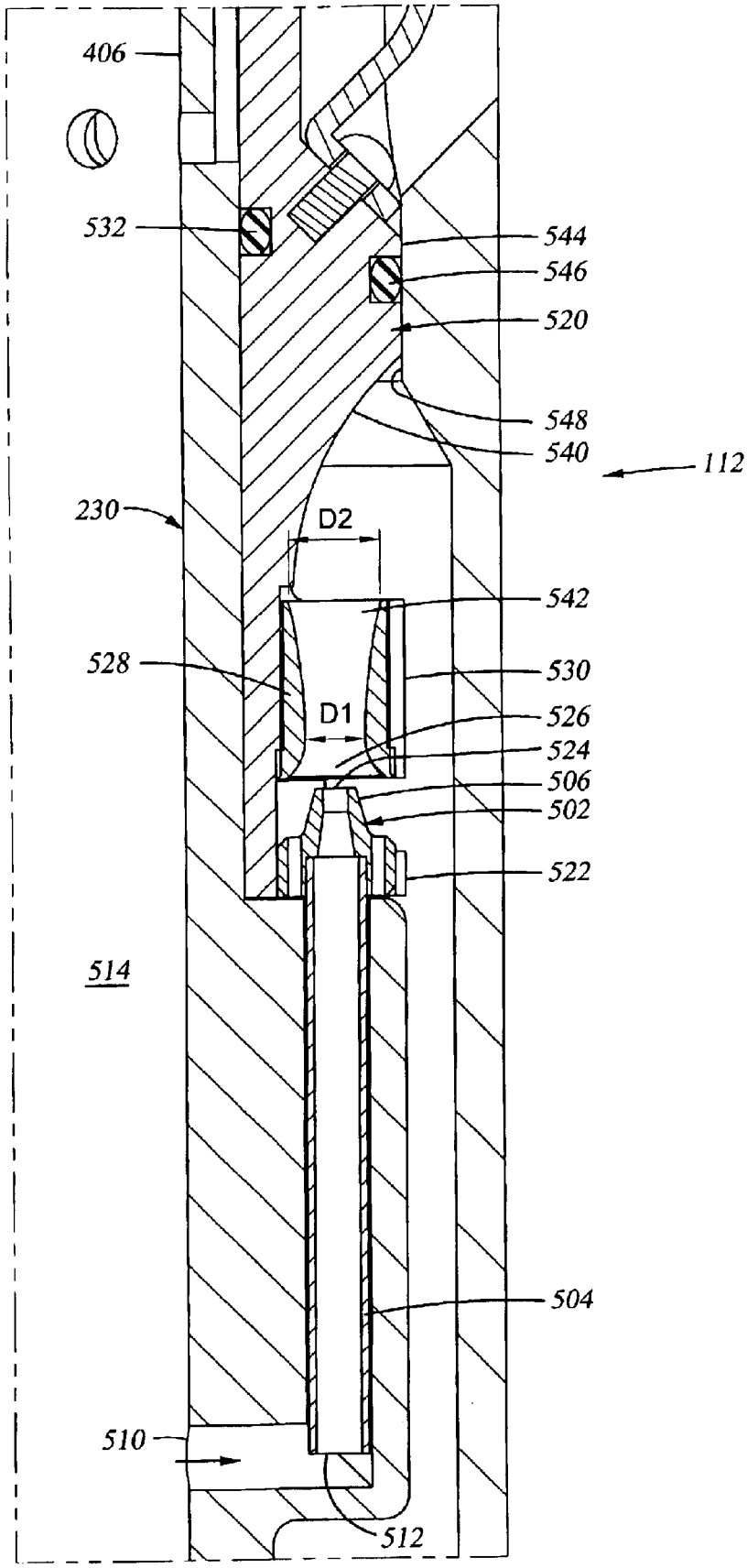
FIG. 5B is a partial cross sectional view of the surge control tool in a valve-open position showing aspects of a Venturi jet system.

Additional details of the inner sleeve 230 will now be described with reference to FIG. 5A and FIG. 5B which show partial cross-sectional views of the tool 112 in the run in position and valve-open position, respectively. In particular, each of the Venturi housings 412 has a radial inlet 510 fluidly connecting an axial opening 512 to an inner sleeve bore 514 traversing a central portion of the tubular portion 406 of the inner sleeve 230. In turn, the central inner sleeve bore 514 is fluidly coupled to the housing bore 220. A Venturi jet 502 is shown disposed in each axial opening 512 of each Venturi housing 412. The Venturi jet 502 generally comprises a tubular portion 504 and an ejection member 506 (e.g., a nozzle). The tubular portion 504 of the Venturi jet 502 is slidably disposed in the axial opening 512 to allow axial movement of the tubular portion 504 therein. The movement of the Venturi Jet 502 within the axial opening 512 is caused by a diverter sleeve 520, which carries the Venturi jet 502 (proximate the ejection portion 506) in an annular flange 522. At its end, the ejection member 506 forms a diametrically reduced expulsion opening 524. The expulsion opening 524 is directed toward an opening 526 formed within a Venturi throat member 528. The opening 526 tapers inwardly from one terminal end (closest to the expulsion opening 524) to a diametrically reduced diameter D1 and then tapers outwardly at its other terminal end to a diametrically enlarged diameter D2. Illustratively, the Venturi throat member 528 is shown as a discrete member disposed within another flange 530 of the diverter sleeve 520. However, in another embodiment the Venturi throat member 528 may be integrally formed as part of the diverter sleeve 520. In still another embodiment, a Venturi throat may be defined by a gap formed between the diverter sleeve 520 and the inner diameter of the housing 204.

Figure 6:
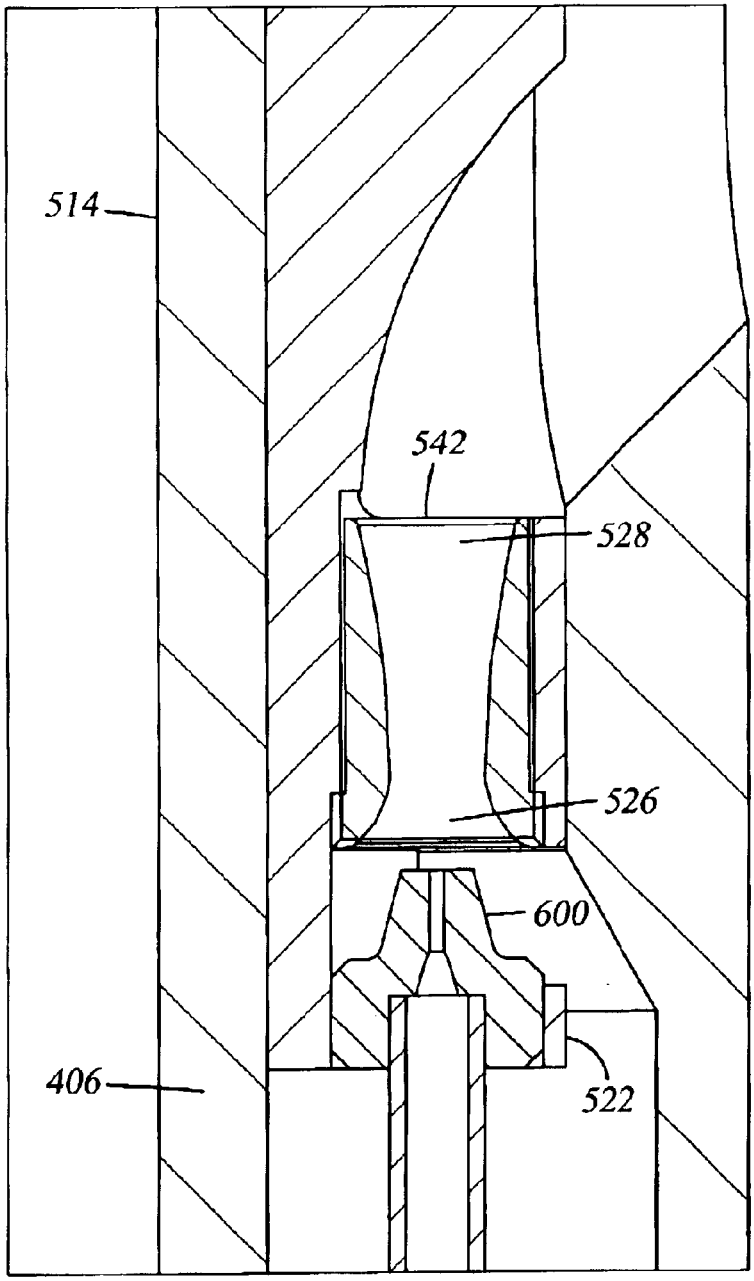
FIG. 6 is a partial cross sectional view of a Venturi jet system having replaceable nozzles.

It should be understood that the foregoing embodiments for creating a Venturi are merely illustrative, and any variety of other embodiments apparent to persons skilled in the art are contemplated by the present inventors and are within the scope of the invention. For example, in some it may be desirable to allow for different flow rates and corresponding pressures. This may be accomplished by the provision of replaceable nozzles, such as the replaceable nozzle 600 shown in FIG. 6. In particular, FIG. 6 shows a replaceable nozzle 600 disposed in the tip of the Venturi jet 502. The replaceable nozzles 600 may be press fitted or otherwise secured in a manner that facilitates easy removal and installation. In this manner, nozzles of differing sizes may be used for different environments.

In still another embodiment the nozzles (or, more generally, discrete ejection points) are not used at all. Rather, as an alternative, a Venturi jet is created with an annular gap. That is, a narrow annular gap may be defined between two surfaces at a radius, for example, equal to the location of the nozzles 524 relative to a central axis traversing the tool 112.

As noted above, the movement of the Venturi jet 502 within the axial opening 510 is caused by the diverter sleeve 520. As such, the diverter sleeve 520 is slidably disposed about the tubular portion 406 of the inner sleeve 230. An O-ring 532 carried on an inner surface of the diverter sleeve 520 ensures a fluid seal with respect to the inner sleeve 230. Likewise, an O-ring 534 carried on an outer surface of the diverter sleeve 520 forms a fluid seal with respect to the housing 204. In particular, the O-ring 534 creates a barrier to fluid flow from a plurality of interstitial spaces 536 defined by the inner surface of the diverter sleeve and the grooves 414. In operation, the interstitial spaces 536 act as flow channels for fluid flowing in and out of the annulus between the housing 204 and the inner sleeve 230 above the diverter sleeve 520 as the diverter sleeve 520 is shifted down or up.

The outer surface of the diverter sleeve 520 generally includes a plurality of flow control surfaces. For example, the diverter sleeve 520 includes a contoured flow diverting surface 540. The flow diverting surface 540 is contoured with an increasing slope from a diametrically reduced portion proximate an outlet end 542 of the Venturi throat member 528 to a diametrically enlarged portion terminating at a sealing surface 544, which carries an O-ring 546. In the run in position (shown in FIGS. 2A–B and FIG. 5A), the flow diverting surface 540 is registered with, and in fluid communication with, the exhaust ports 222. Further, in this position, the outer surface of the flange 530 housing the Venturi throat member 528 is in substantially sealing engagement with a sealing surface formed on the inner surface of the housing 204.

Figure 7:
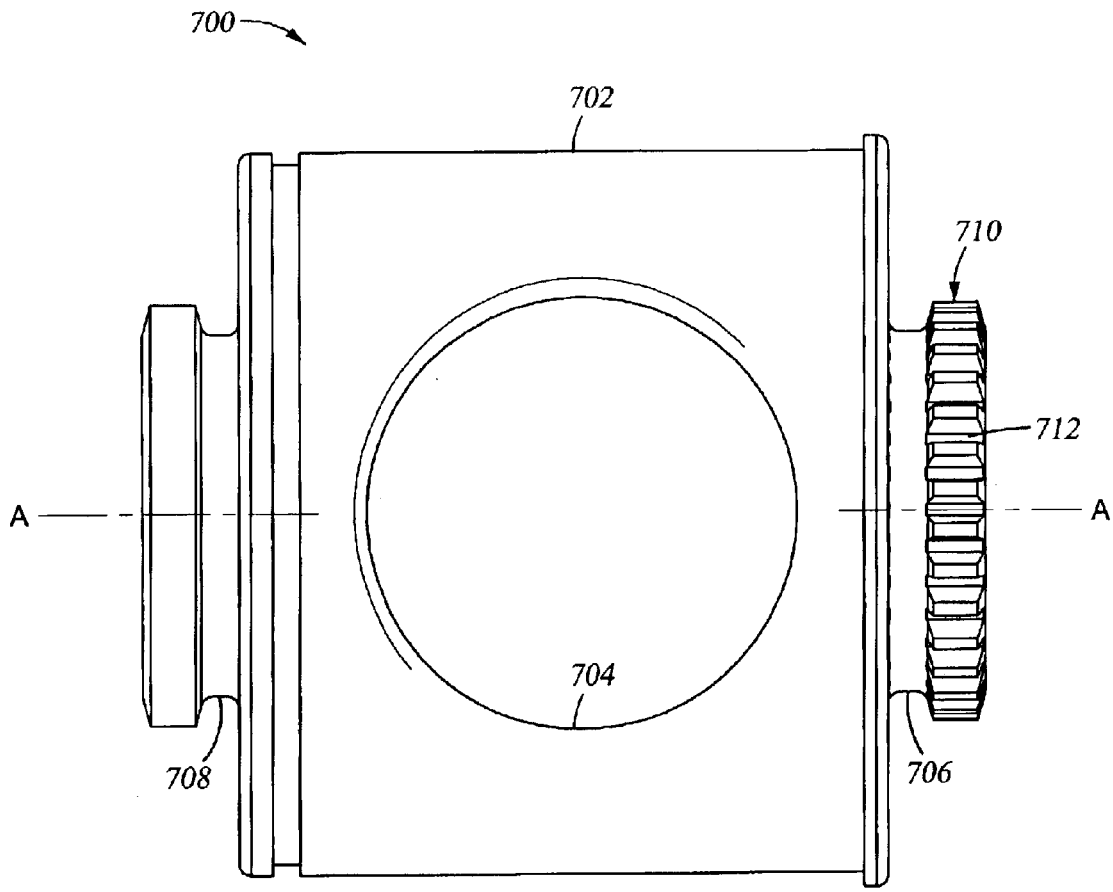
FIG. 7 is an elevational view of a valve.

In one embodiment, the diverter sleeve 530 actuates a valve disposed in the tool. One embodiment of a valve 700 is shown in FIG. 7. The valve 700 generally comprises a body 702 having a fluid flow channel 704 formed therein. Illustratively, the valve 700 is a plug valve rotatable about a central axis A, thereby allowing the valve 700 to be placed in a closed position (preventing fluid flow through the channel 704) and an opened position (allowing fluid flow through the channel 704). In one embodiment, rotation of the valve 700 is achieved by the provision of a gear wheel 710 fixedly connected to the body 702 and concentrically disposed with respect to the axis A. The gear wheel 710 comprises a plurality of cogs 712 adapted to be intermeshed with the cogs of a gear arm (described below). In one embodiment, the valve 700 comprises a pair of stabilizing annular glide surfaces 706, 708, one disposed on each side of the body. As will be described below, the glide surfaces interact with a stabilizer to ensure stability of the valve 700 during operation.

Figure 8:
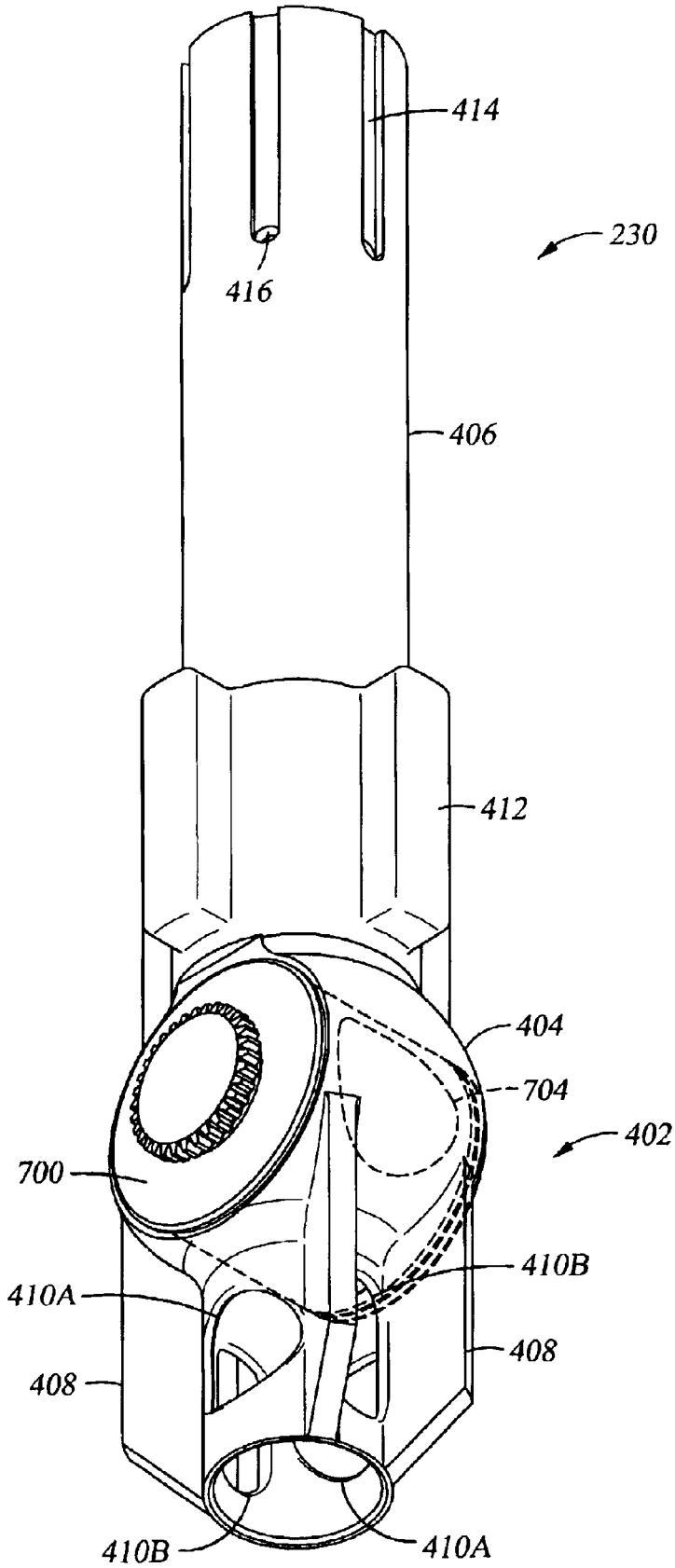
FIG. 8 is an elevational view of the surge control tool having the valve of FIG. 7 disposed in the inner sleeve while in a closed position.
Figure 9:
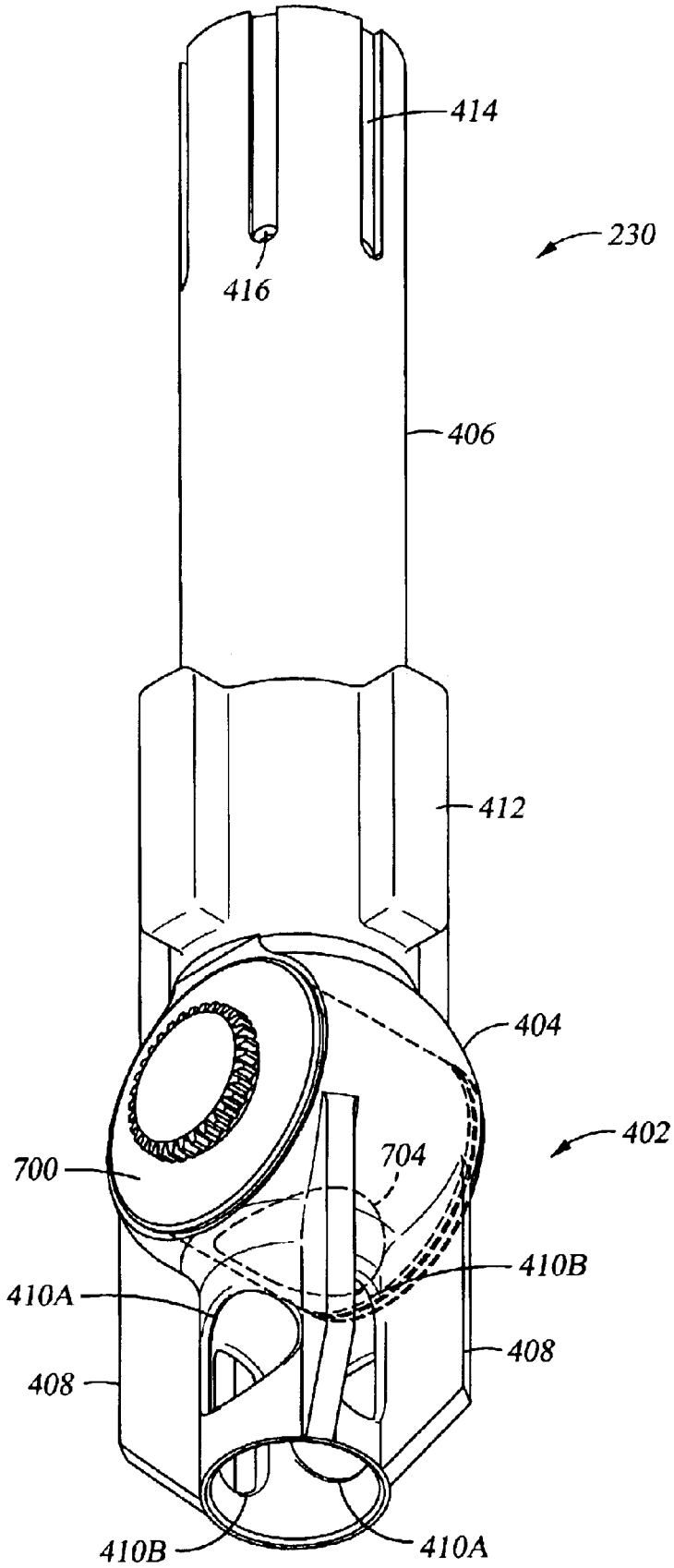
FIG. 9 is an elevational view of the surge control tool having the valve of FIG. 7 disposed in the inner sleeve while in an open position.

In one embodiment, the valve 700 is disposed in the valve housing 404 of the inner sleeve 230. Such an arrangement is shown in FIG. 8 and FIG. 9. Referring first FIG. 8, the valve 700 is shown in the closed position, which is maintained in the run in position of the tool 112. A portion of the valve 700 is shown by hidden lines to show the orientation of the fluid flow channel 704. Referring now to FIG. 9, the valve 700 is shown in the open position, whereby fluid flow through the channel 704 is permitted.

Figure 10:
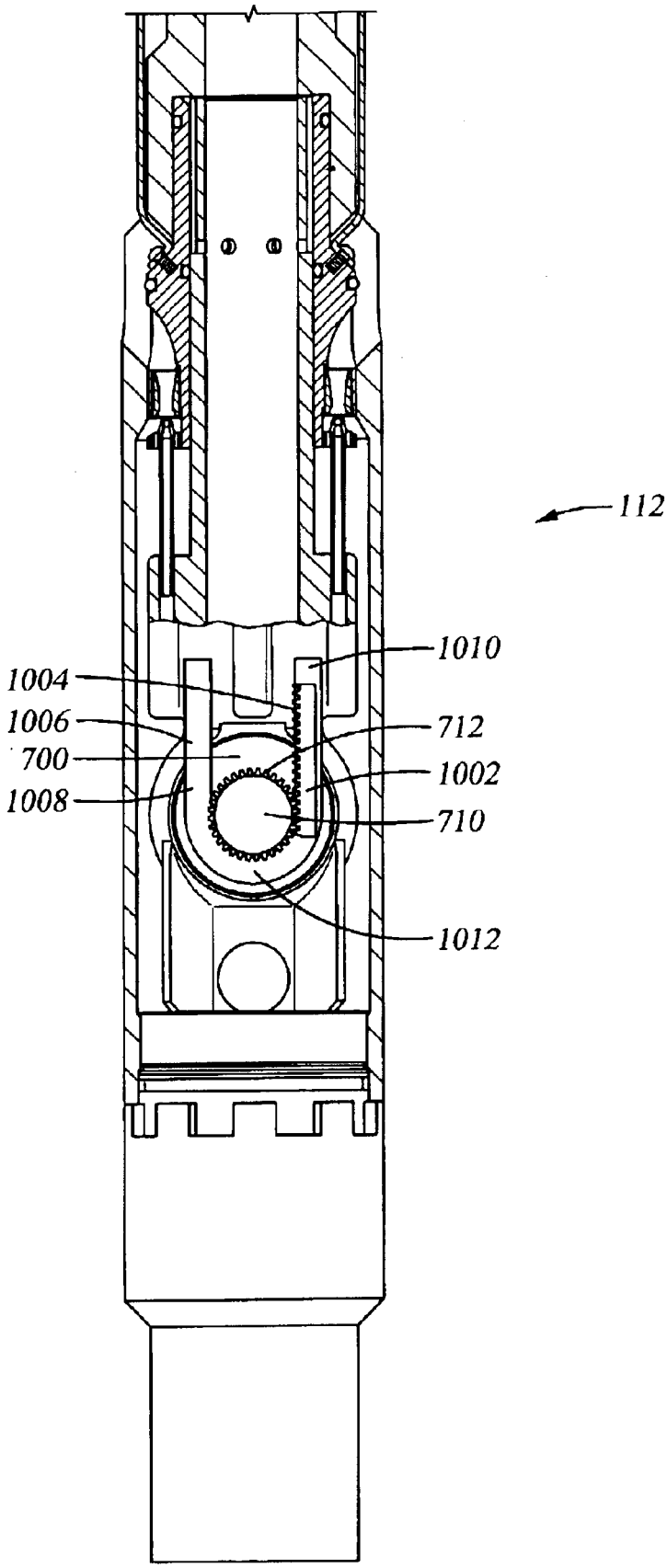
FIG. 10 shows a configuration of the surge control tool in which the valve of FIG. 7 is closed.
Figure 11:
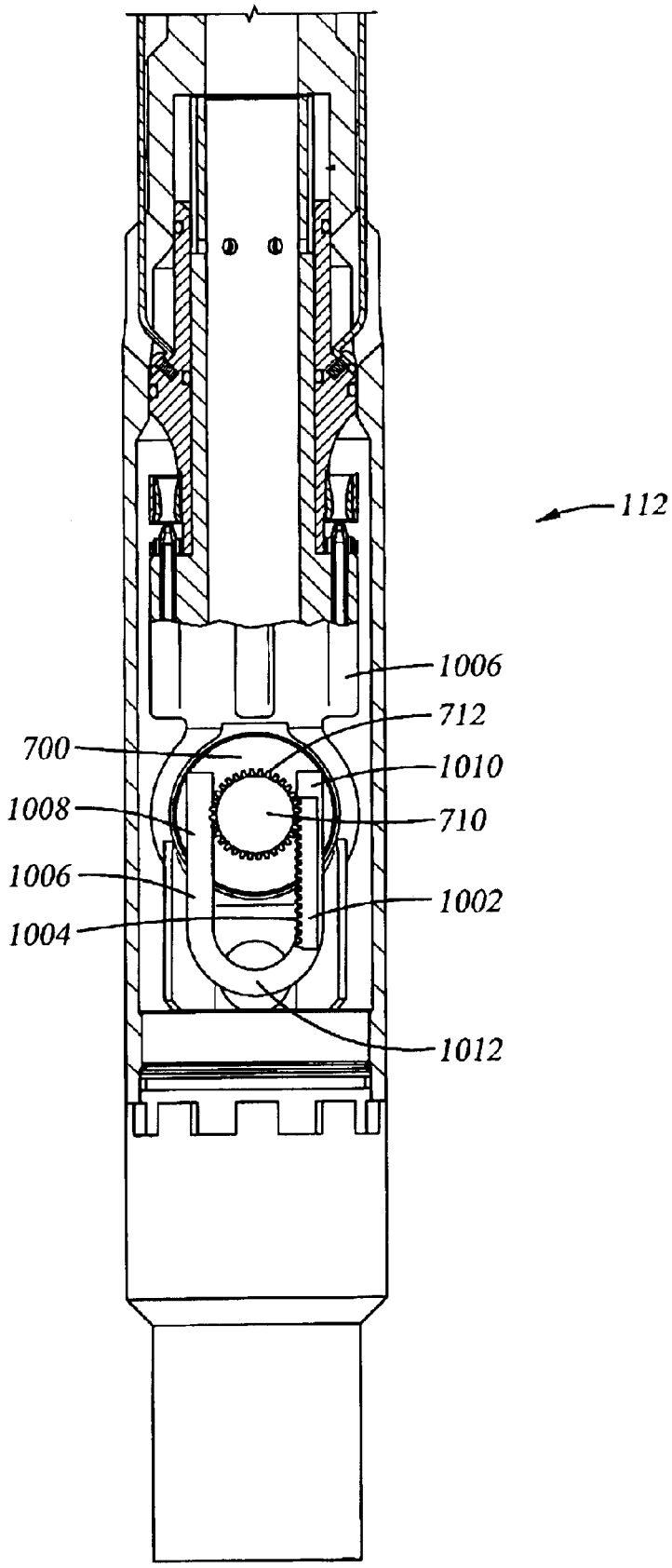
FIG. 11 shows a configuration of the surge control tool in which the valve of FIG. 7 is open.

As noted above, actuating of the valve 700 between the closed position in the open position may be achieved by a gear assembly, which includes the gear wheel 710. One such embodiment is shown in FIG. 10 and FIG. 11. In particular, FIG. 10 shows a configuration of the tool 112 in which the valve 700 is closed, corresponding to FIG. 8, and FIG. 11 shows a configuration of the tool 112 in which the valve 700 is open, corresponding to FIG. 9. In either case, the cogs 712 of the gear wheel 710 are intermeshed with the cogs 1004 of a gear arm 1002. In one embodiment, the gear arm 1002 is connected to the diverter sleeve 520. (The diverter sleeve 520 is not shown to reveal aspects of the gear arm and related components with more clarity.) Accordingly, actuation of the diverter sleeve 520 causes actuation of the valve 700. As the diverter sleeve 520 drives the gear arm 1002 forward (i.e., toward the lower sub 202), interaction between the gear arm 1002 and the gear wheel 710 rotates the valve 700 into the open position, shown in FIG. 11.

In the embodiments of FIG. 10 and FIG. 11 a U-shaped stabilizer 1006 is shown. The stabilizer 1006 generally includes a pair of arms 1008, 1010 connected to either end of an arcuate member 1012. The inner surfaces of the arms 1008, 1010 are slidably disposed on the glide surface 706 disposed between the gear wheel 710 and the body 702 of the valve 700. In one embodiment, the stabilizer 1006 is connected to the diverter sleeve 520 and the gear arm 1002 is connected to the stabilizer 1006. In an alternative embodiment, the stabilizer 1006 and the gear arm 1002 are separately connected to the diverter sleeve 520. In any case, the gear arm 1002, the stabilizer 1006 and the diverter sleeve 520 are connected to one another so as to achieve cooperative reciprocating movement. Further, although only one stabilizer 1006 is shown, another embodiment includes a second stabilizer slidably disposed on the glide surface 708 (shown in FIG. 7). In still another embodiment, the tool 112 does not include a stabilizer.

Referring back to FIGS. 2A–B, the tool 112 is shown further comprising a drag spring cage 240. The drag spring cage 240 generally comprises a plurality of flexture members, referred to herein as drag springs 246. The drag springs 246 are generally flexible arcuate members connected at one end to an upper sleeve 242 and at another end to a lower sleeve, also referred to herein as an actuator sleeve 244. The drag springs 246 bow outwardly away from the housing 204 to a degree sufficient to contact the inner diameter of a casing when the tool 112 is placed downhole (as shown in FIG. 1). Additional details of the drag spring cage 240 and tool 112 generally will now be described with reference to FIG. 12A.

Figure 12A:
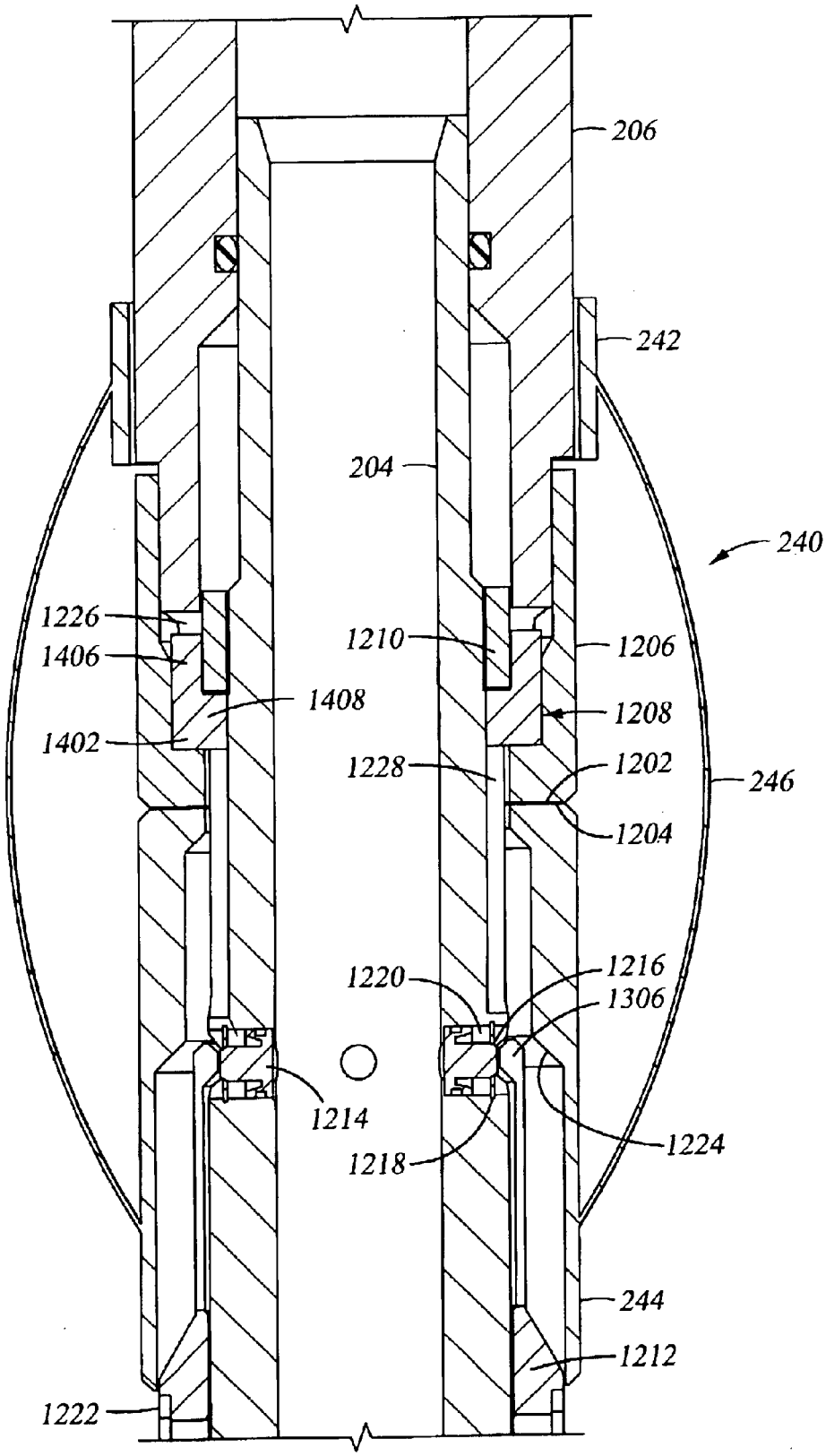
FIG. 12A is a partial cross sectional view of the surge control tool showing aspects of a drag spring cage, an actuator collet and a plurality of actuator bars while in a valve closed position (run in position).

FIG. 12A shows a partial cross-sectional view of the tool 112 in the run in position. In this position, the upper sleeve 242 is slidably disposed over the outer surface of the upper body 206. Further, an outer shoulder surface 1202 of the actuator sleeve 244 is engaged with an outer shoulder surface 1204 of an outer nut 1206. The nut 1206 is a generally cylindrical member slidably disposed with respect to the housing 204. An outer diameter of the nut 1206 is substantially equal to an outer diameter of the upper body 206, thereby forming a substantially contiguous surface over which the upper sleeve 242 of the drag cage 240 can slide. In the illustrative embodiment, the outer nut 1206 is disposed over and about a torque ring 1208 which, in turn, is slidably disposed over the housing 204. Aspects of the torque ring 1208 will be described in more detail below. However, it should be mentioned at this time, that the torque ring 1208 is slidably disposed over the housing 204 and has its range of motion limited at one end by an inner nut 1210, which is threadedly secured to the housing 204.

Figure 12B:
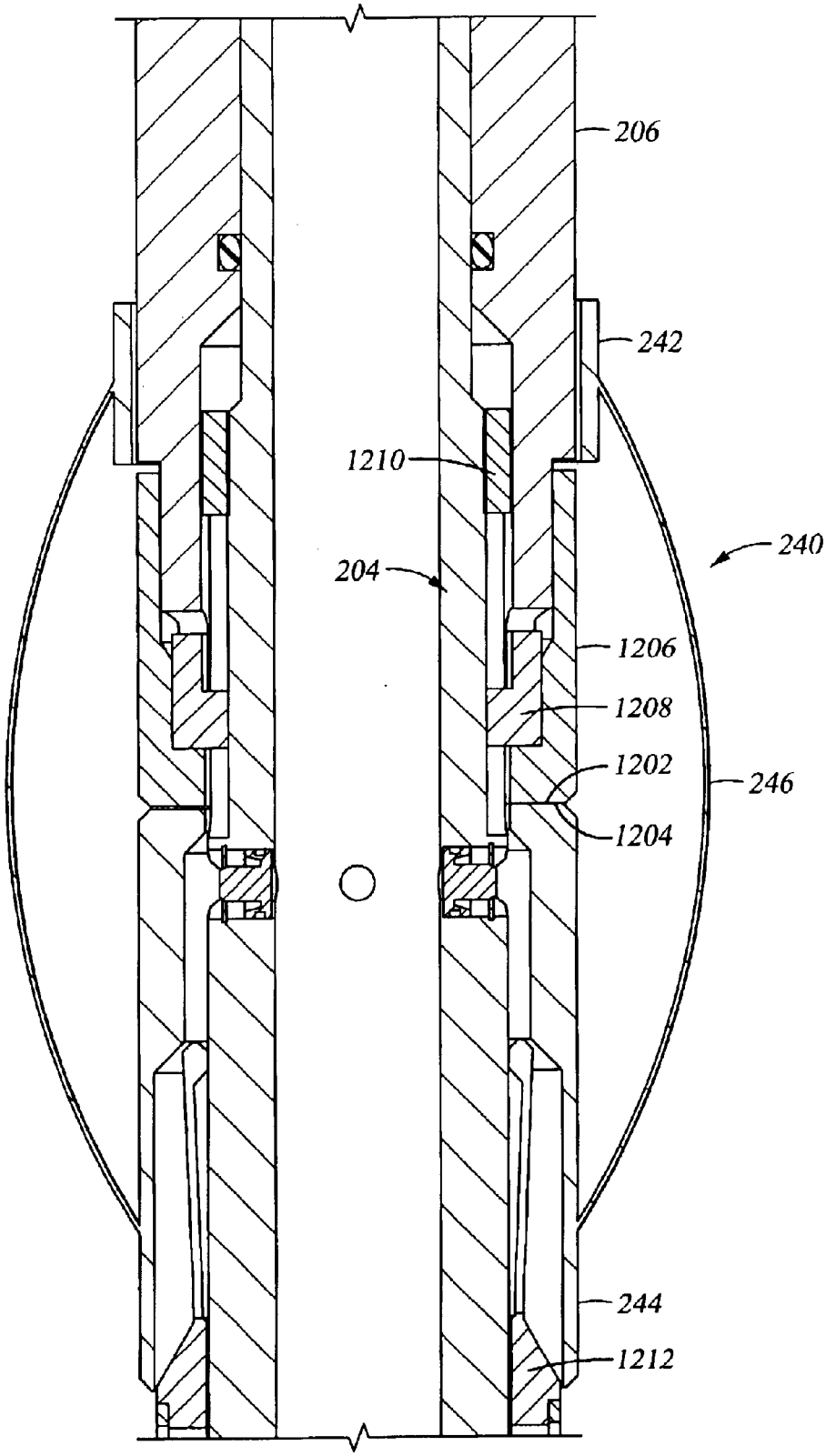
FIG. 12B is a partial cross sectional view of the surge control tool showing aspects of a drag spring cage, an actuator collet and a plurality of actuator bars while in a valve open position.
Figure 13:
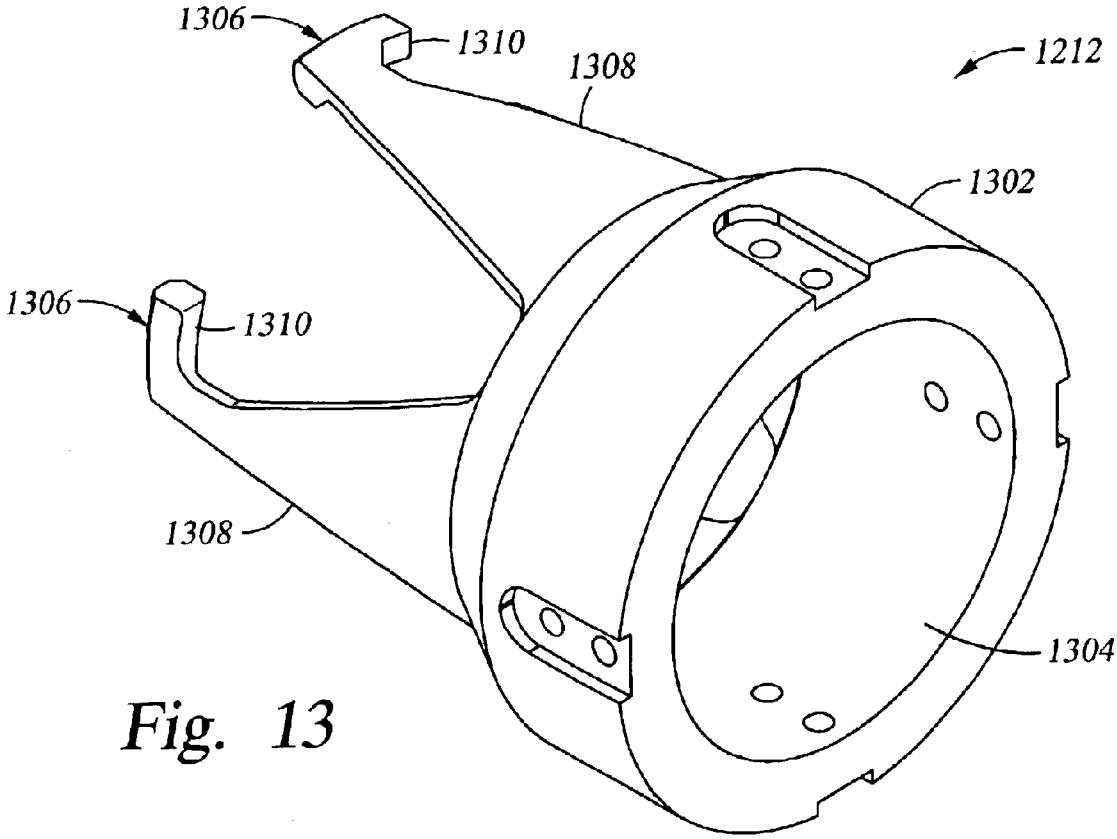
FIG. 13 is a perspective view of a collet sleeve (also referred to herein as an actuator collet).

The tool 112 is further equipped with an actuator collet 1212. Aspects of the actuator collet 1212 will be briefly described with reference to FIG. 13. In general, the actuator collet 1212 comprises a cylindrical body 1302 defining a central opening 1304 sized to receive the housing 204 therein. A plurality of collet fingers 1306 extend from one side of the body 1302. Illustratively, the actuator collet 1212 is equipped with four collet fingers 1306. Each collet finger 1306 generally comprises a collet finger body 1308 having a hook shaped portion 1310 disposed at a terminal end thereof. Referring again to FIG. 12A, the actuator collet 1212 is shown slidably disposed about the housing 204. Further, in the depicted run in position, each collet finger 1306 (and more specifically, each hook shaped portion 1310) is disposed over a pressure actuated piston 1214, each housed in a respective opening 1216 formed in the housing 204. The pistons 1214 are biased into a seated position by the provision of a spring 1220 secured at one end by a snap ring 1218. When a sufficient pressure exists in the housing bore, the pistons 1214 are actuated radially outward, thereby deflecting the collet fingers 1306 outward, as shown in FIG. 12B.

As can be seen in FIG. 12A, the activator collet 1212 carries a plurality of actuator arms 1222 on its outer surface. In the illustrated embodiment, the activator collet 1212 carries four actuator arms 1222. However, any number of actuator arms 1222 can be used to advantage. The distal ends of each of the actuator arms 1222 are coupled to the diverter sleeve 520, as can be seen in FIG. 5A. In this manner, the actuator arms 1222 couple the actuator collet 1212 with the diverter sleeve 520, thereby ensuring cooperative axial movement during operation.

The operation of the tool 112 will now be described with reference to one or more of the figures described above as well as additional figures, as necessary. Initially, the tool 112 is made up according to an intended purpose. For example, in the case of hanging liners 108 in a wellbore 102, a liner running tool 114 may be connected to the lower sub 201, as shown in FIG. 1. The configuration of the tool 112 during run in the shown in FIGS. 2A–B. As the tool 112 is lowered into the wellbore 102, the drag springs 246 of the drag cage 240 contact the inner diameter of the casing 106. Sufficient friction between the drag springs 246 and the casing 106 urges the drag cage 240 upward, thereby maintaining the outer shoulders 1202 and 1204 in mating abutment. As the tool 112 is submerged in wellbore fluid, the wellbore fluid is allowed to eventually enter the inlet bore 208 formed in the lower sub 202. Because the valve 700 is in a closed position, the wellbore fluid is caused to flow through the ports 410 and into the cavity 216 formed between the inner sleeve 230 and the inner surface of the housing 204. The fluid flow path of the wellbore fluid continues through the Venturi throat member (i.e., into the inlet 526 and out the outlet 542) and finally out the exhaust ports 222 formed in the housing 204.

While at least a portion of the tubular string downstream of the tool 112 is submerged, and if the submerged portion is in fluid communication with the lower inlet 208 of the tool 112, flow of the wellbore fluid along the path described above can be motivated, at least in part, by the Venturi pump system of the present invention. In operation, the Venturi pump system is operated by flowing a fluid from the pumping facility 118 (FIG. 1) into the upper inlet bore 218, through the housing bore 220 and into the inner sleeve bore 514. With the valve 700 in the closed position, the fluid is then pumped into the radial inlet 510 and then into the tubular portion 504 of the Venturi jet 502. The fluid is exhausted from the nozzle 506 of the jet 502 with sufficient velocity to create a desired pressure drop. As a result, wellbore fluid is motivated by the pressure drop to flow through the Venturi throat member 528 and then out through the exhaust ports 222 (i.e., into the annulus formed between the outer diameter of the surge control tool 112 and the inner diameter of the casing 106).

Note that wellbore fluid flow can be motivated in this way to substantially eliminate surge pressure by adjusting the motive fluid flow through the Venturi jet 502. In another aspect, with sufficient motive fluid flow through the Venturi jet 502, a negative surge pressure may be created which draws wellbore fluid through the tool 112 at a greater rate than would be possible without a Venturi effect. Where a negative surge pressure is established, the tool 112 may, in fact, be propelled through the wellbore to some degree.

When a sufficient pressure exists within the housing bore 220, the pistons 1214 are urged radially outward through the opening 1216 and into contact with the collet fingers 1306, thereby deflecting the collet 1306 fingers outward, as shown in FIG. 12B. With full deflection, the collet fingers 1306 are disposed against an inner surface of the actuator sleeve 244 and proximate a tapered surface 1224 formed on the actuator sleeve 244.

At some point, it will be desirable to activate the tool 112, i.e., open the valve 700 and seal the exhaust ports 222. Opening the valve 700 allows fluid communication through the axial bore traversing the length of the tool 112, i.e., between the lower bore 208 formed in the lower sub 202 and the upper bore 218 formed in the upper body 206. Sealing the exhaust ports 222 prevents wellbore fluid from returning to the annulus, and allows an increase in the pressure differential between the inside of a drill-pipe/liner and the annulus.

In one embodiment, the tool 112 is activated by moving it upward. For example, the working string to which the tool 112 is connected may be manipulated from the surface to initiate an upward motion on the tool 112 while the pump 118 maintains a certain pressure inside the tool 514. Because the drag springs 246 are friction-engaged with the casing in the wellbore, the drag cage 240 remains stationary relative to the upper body 206, housing 204, inner sleeve 230 and lower sub 202. With continuing relative movement between these components, the tapered surface 1224 of the actuator sleeve 244 engages the collet fingers 1306 (which are in a deflected position due to a pressure differential), thereby driving the actuator collet 1212 downward relative to the housing 204. Relatively, the movement of the actuator collet 1212 is translated to the diverter sleeve 520 via the actuator bars 1222. The axial travel of the diverter sleeve 520 drives the tubular portion 504 of the Venturi jets 502 into the axial openings 512 formed in the Venturi housings 412 of the inner sleeve 230. The diverter sleeve 520 continues its downward movement until bottoming out against the Venturi housing 412. In the terminal position (shown for example in FIGS. 3B and 5B), the sealing surfaces 548, 544 of the housing 240 and the diverter sleeve 520, respectively, are engaged with one another, thereby preventing further fluid flow from the cavity 216 through the exhaust ports 222.

Further, the above-described actuation, also operates to actuate the valve 700 from a closed position to an open position. Specifically, the gear arm 1002 (which is coupled to the diverter sleeve 520) is driven downward. Accordingly, the intermeshed cogs 1004, 712 of the gear arm 1002 and the gear wheel 710, respectively, cause the linear movement of the gear arm 1002 to be translated into rotation of the valve 700. In the terminal position of the gear arm 1002 (shown in FIG. 11), the valve 700 is in an open position.

In one embodiment, the tool 112 is configured with a redundant actuation mechanism. The redundant actuation mechanism provides an alternative means of actuating the tool (i.e., changing the configuration of the tool from the run in configuration/position to the actuated configuration/position), which may be advantageous, for example, when the tool 112 becomes lodged against a wellbore formation and cannot be actuated in hydraulic/mechanical method described above. One embodiment of a redundant actuation mechanism will be described with reference to FIG. 12A, FIG. 14 and FIG. 15.

Figure 14:
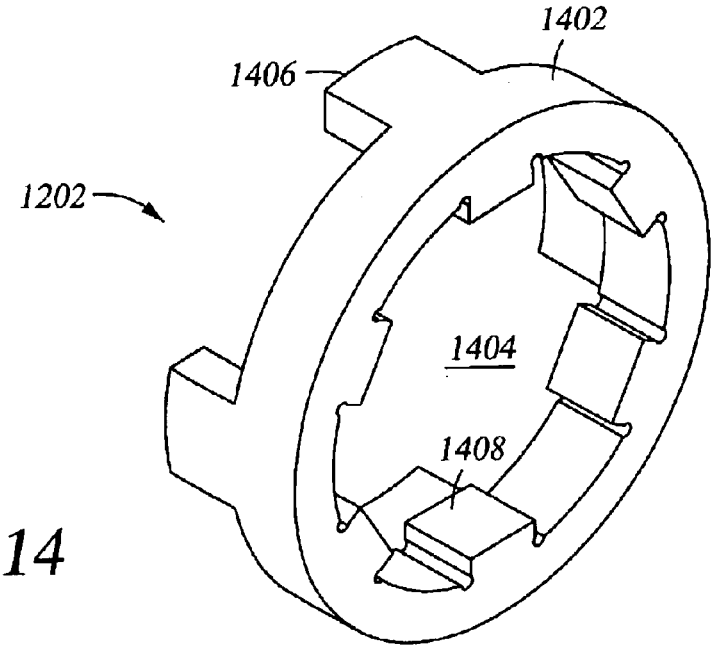
FIG. 14 is a perspective view of a torque ring.

Referring first FIG. 12A, the surge control tool 112 is shown in the run in position. In one embodiment, the redundant actuation mechanism generally comprises the outer nut 1206, the torque ring 1208, and the upper body 206. Referring briefly to FIG. 14, an embodiment of the torque ring 1208 is shown. The torque ring 1208 is a generally annular member having a main body 1402 defining a central opening 1404, a plurality of axial torque keys 1406 (four shown) disposed on the main body 1402, and a plurality of radial torque keys 1408 (six shown) disposed on the body and extending radially into the opening 1404. Referring again to FIG. 12A, it can be seen that the axial torque keys 1406 are disposed over the inner nut 1210. Further, each axial torque key 1406 extends into a recess 1226 formed in the upper body 206. A gap formed between the axial torque keys 1406 and the upper body 206 provides a clearance which ensures contact between the upper body 206 and the main body 1402 of the torque ring 1202 in the area between the axial torque keys 1406. Further, the radial torque keys 1408 are slidably disposed in a groove 1228 formed in the housing 204. In this manner, the torque ring 1208 is prevented from rotating about the housing 204. Further, because the upper body 206 and torque ring 1208 are interlocked (by virtue of the axial torque keys 1406 extending into the recesses 1226), a torque applied to the upper body 206 is translated to the housing 204 through the torque ring 1208.

Figure 15:
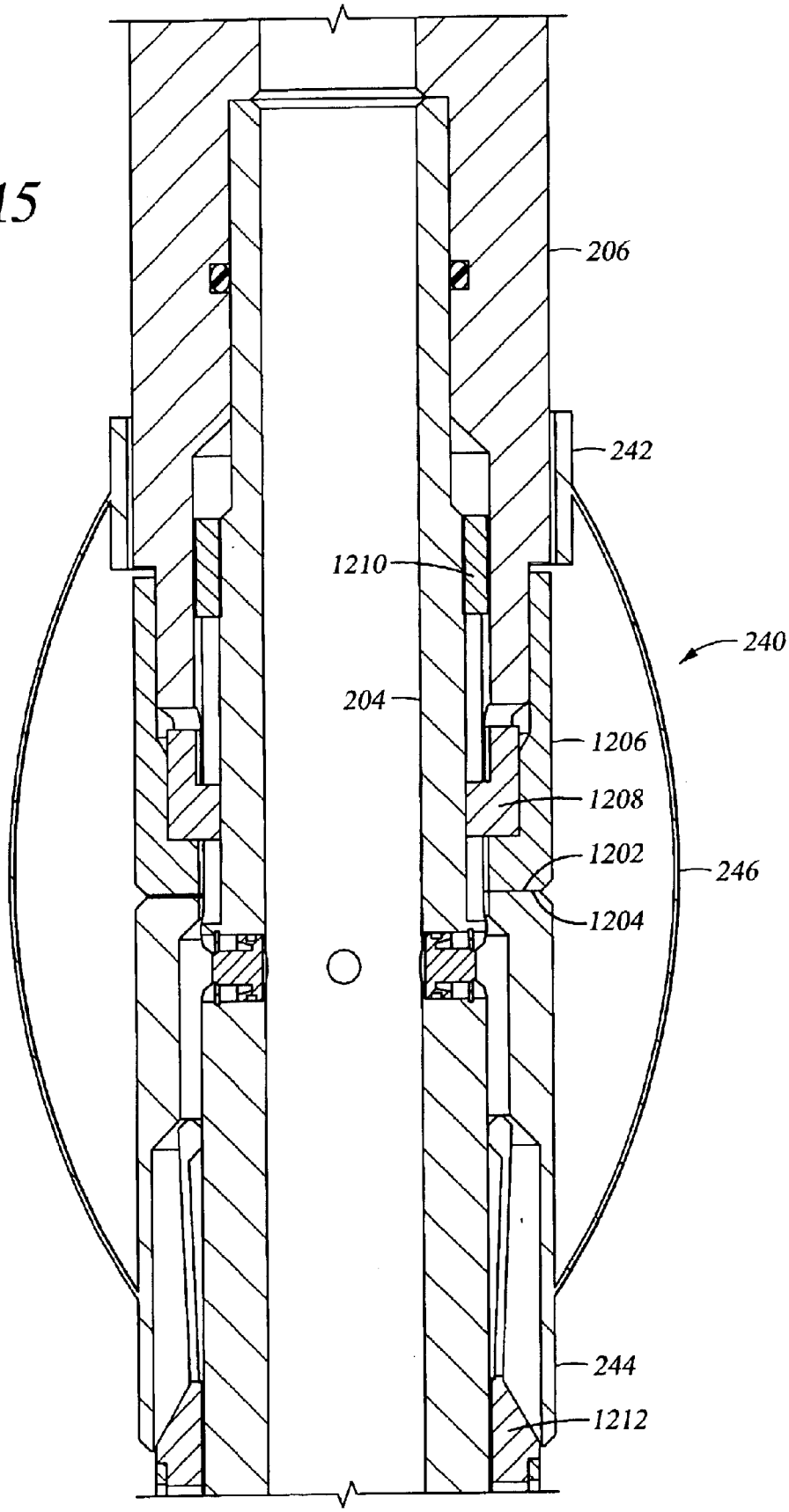
FIG. 15 is a partial cross sectional view of the surge control tool in a valve open position showing aspects of a redundant actuation mechanism operated by putting the tool in compression.
Figure 13:
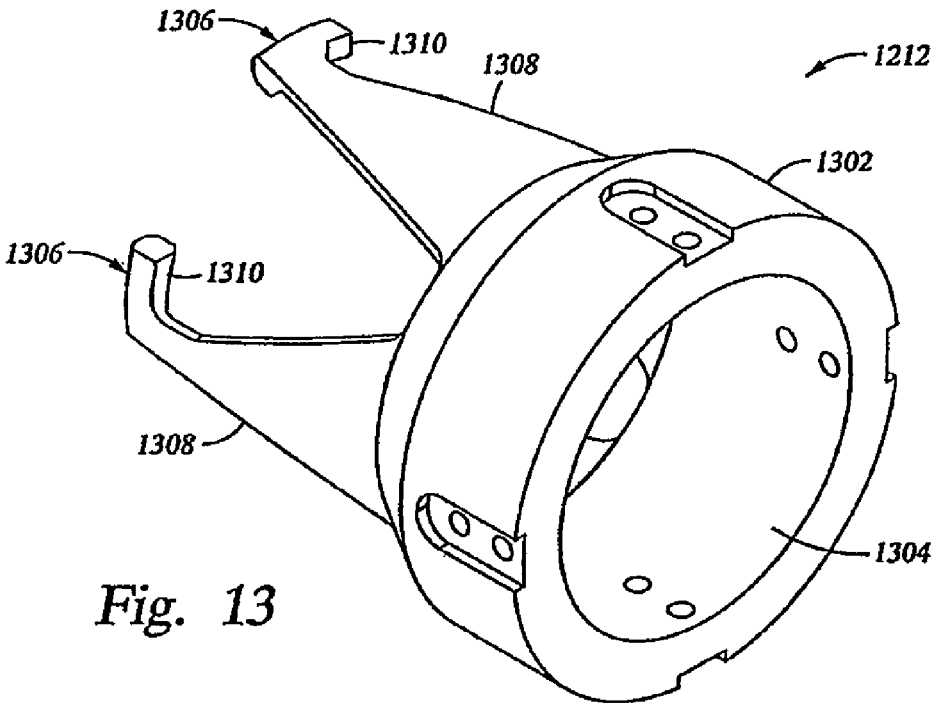
Figure 14:
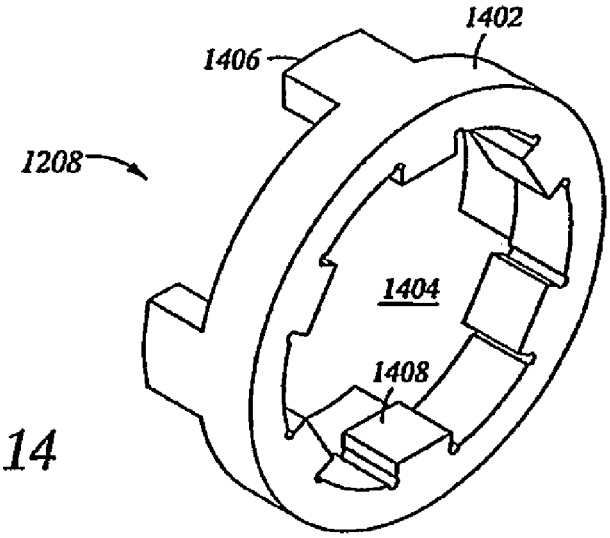

The redundant actuation mechanism is activated by placing weight down on the surge control tool 112, thereby causing the redundant actuation mechanism to telescopically collapse. Specifically, the upper body 206 engages and drives the torque ring 1208 downward with respect to the housing 204. In turn, the torque ring 1208 drives the outer nut 1206 downward, thereby causing the shoulder 1204 of the outer nut 1208 to engage the shoulder 1202 of the actuator sleeve 244 and drive the actuator sleeve 244 downward. Travel terminates when the upper body 206 bottoms out on the upper end of the housing 204. The remaining aspects of actuation are the same as those described above. The terminal position of the redundant actuation mechanism is shown in FIG. 15.

It should be noted that even where the redundant actuation mechanism is used, the outer nut 1206, the torque ring 1208 and the upper body 206 do not move relative to one another. As such, is contemplated that these components may be formed as a singular monolithic component.

Once the tool 112 is placed in the open position (regardless of by which operation), the tool 112 now has an unobstructed opening/bore extending through its length, and the communication to the annulus is closed. Operations may then be performed to, for example, release a liner. In one operation, a dropped ball can be passed through the tool 112 and land in a baliseat located further down the working string to create a seal. The seal allows for an increase in internal pressure sufficient to activate the liner hanger and release the running tool 112. In the open position, the tool 112 also allows for cement to be pumped through the tool 112 with one or more spacer darts preceding or following the cement column. Being able to quickly place the tool 112 in the open position further facilitates a quick response to an uncontrolled situation, such as when the well starts producing oil or gas. In such a situation it is extremely important to be able to quickly pump well fluid with high specific gravity into the well to counteract the well's ability to produce.

While the foregoing is directed to the preferred embodiment of the present invention, other and further embodiments of the invention may be devised without departing from the basic scope thereof, and the scope thereof is determined by the claims that follow.

What is claimed is:

1. A downhole surge control tool defining an exhaust port for venting fluid, comprising:

a body having (i) a first opening at a first end, (ii) a second opening at a second end and (iii) defining a bore traversing the tool to fluidly couple the first opening and the second opening;

a wellbore fluid bypass path defined between the first opening and the exhaust port;

a fluid motivator to motivate fluid flow through the bypass fluid path and out through the exhaust port, wherein the fluid motivator comprises a fluid ejection member forming an expulsion opening oriented into at least a portion of the bypass fluid path, whereby fluid expelled from the fluid ejection member motivates fluid flow through the bypass fluid path; and a sealing member disposed in a cavity of the body and adapted to selectively seal the fluid bypass path.

2. The downhole surge control tool of claim 1, wherein the fluid motivator is a pump.

3. The downhole surge control tool of claim 1, wherein the fluid ejection member is fluidly coupled to a surface-located pressurized fluid source.

4. The downhole surge control tool of claim 1, wherein the fluid ejection member is a Venturi jet.

5. The downhole surge control tool of claim 4, wherein the Venturi jet is fluidly coupled to a surface-located pressurized fluid source.

6. The downhole surge control tool of claim 1, further comprising a Venturi throat member defining a relatively diametrically restricted opening adapted to cause a pressure drop for fluid flowing therethrough, and wherein the expulsion opening is oriented into the relatively diametrically restricted opening of the Venturi throat member.

7. The downhole surge control tool of claim 1, further comprising a Venturi throat member carried by the sealing member and defining a relatively diametrically restricted opening adapted to cause a pressure drop for fluid flowing therethrough.

8. The downhole surge control tool of claim 7, wherein the Venturi jet is disposed on the sealing member.

9. The downhole surge control tool of claim 1, further comprising a friction actuated assembly axially and slidably disposed about the body and operably connected to the sealing member to actuate the sealing member.

10. The downhole surge control tool of claim 9, wherein the friction actuated assembly comprises a drag cage.

11. The downhole surge control tool of claim 10, wherein the drag cage comprises:

a first sleeve axially and slidably disposed about the body;

a second sleeve axially and slidably disposed about the body;

a plurality of drag springs connected at one end to the first sleeve and at a another end to the second sleeve.

12. The downhole surge control tool of claim 10, further comprising a collet sleeve axially and slidably disposed between at least a portion of the drag cage and the body, the collet sleeve comprising a plurality of flexible collet fingers and positionable in a deflected position to contact the drag cage, whereby axial movement of the drag cage in at least one direction causes a corresponding axial movement of the collet sleeve in the at least one direction while the flexible collet fingers are in the deflected position.

13. The downhole surge control tool of claim 12, further comprising a plurality of pressure actuated pistons disposed in the body, wherein each piston, when actuated, causes one of the flexible collet fingers to be placed in the deflected position.

14. The downhole surge control tool of claim 10, further comprising a telescoping drive member axially and slidably disposed with respect to the body and comprising a drag cage contact surface for contacting and axially driving the drag cage.

15. The downhole surge control tool of claim 14, wherein the telescoping drive member comprises a torque ring comprising a plurality of torque keys disposed in respective grooves formed on the body.

16. A downhole surge control tool, comprising:

a body having a first opening at a first end and a second opening at a second end and defining a bore traversing the tool to fluidly couple the first opening and the second opening;

a valve disposed in the bore and positionable in at least (i) a closed position to at least restrict fluid flow between the first opening and the second opening via the bore and (ii) an open position to allow fluid flow between the first opening and the second opening via the bore;

a sealable fluid bypass path defined between the first opening and an exhaust port formed in the body; and a fluid ejection member forming an expulsion opening oriented into at least a portion of the fluid bypass path, whereby fluid expelled from fluid ejection member motivates fluid flow through the sealable bypass fluid path.

17. The downhole surge control tool of claim 16, wherein the fluid ejection member is fluidly coupled to a surface-located pressurized fluid source.

18. The downhole surge control tool of claim 16, wherein the fluid bypass path is open only while the valve is in the closed position.

19. The downhole surge control tool of claim 16, further comprising a sealing member disposed in a cavity of the body and adapted to selectively seal the fluid bypass path.

20. The downhole surge control tool of claim 19, wherein the fluid ejection member is disposed on the sealing member.

21. The downhole surge control tool of claim 19, further comprising a drag cage axially and slidably disposed about the body and operably connected to the sealing member to actuate the sealing member.

22. The downhole surge control tool of claim 21, wherein the drag cage comprises:

a first sleeve axially and slidably disposed about the body;

a second sleeve axially and slidably disposed about the body;

a plurality of drag springs connected at one end to the first sleeve and at a another end to the second sleeve.

23. The downhole surge control tool of claim 21, further comprising a collet sleeve axially and slidably disposed between at least a portion of the drag cage and the body, the collet sleeve comprising a plurality of flexible collet fingers and positionable in a deflected position to contact the drag cage, whereby axial movement of the drag cage in at least one direction causes a corresponding axial movement of the collet sleeve in the at least one direction while the flexible collet fingers are in the deflected position.

24. The downhole surge control tool of claim 23, further comprising a plurality of pressure actuated pistons disposed in the body, wherein each piston, when actuated, causes one of the flexible collet fingers to be placed in the deflected position.

25. The downhole surge control tool of claim 21, further comprising a telescoping drive member axially and slidably disposed with respect to the body and comprising a drag cage contact surface for contacting and axially driving the drag cage.

26. The downhole surge control tool of claim 25, wherein the telescoping drive member comprises a torque ring comprising a plurality of torque keys disposed in respective grooves formed on the body.

27. A downhole surge control tool, comprising:

a body having a first opening at a first end and a second opening at a second end and defining a bore traversing the tool to fluidly couple the first opening and the second opening;

a valve disposed in the bore and positionable in at least (i) a closed position to at least restrict fluid flow between the first opening and the second opening via the bore and (ii) an open position to allow fluid flow between the first opening and the second opening via the bore;

a sealable fluid bypass path defined between the first opening and an exhaust port formed in the body;

a fluid ejection member forming an expulsion opening oriented into at least a portion of the fluid bypass path, whereby fluid expelled from fluid ejection member motivates fluid flow through the sealable bypass fluid path;

a sealing member disposed in a cavity of the body and positionable in a closed position to seal the fluid bypass path and an open position to open the fluid bypass path;

a collet sleeve axially and slidably disposed with respect to the body and comprising a plurality of collet fingers; and one or more connecting members connecting the collet sleeve to the sealing member.

28. The downhole surge control tool of claim 27, wherein the sealing member is axially and slidably disposed with respect to the body.

29. The downhole surge control tool of claim 27, wherein the sealing member comprises a contoured flow diverting surface which forms a portion of the fluid bypass path while the sealing member is in the open position.

30. The downhole surge control tool of claim 27, wherein the valve and the sealing member are operably connected, so that the valve is in the closed position while the sealing member is in the open position and the valve is in the open position while the sealing member is in the closed position.

31. The downhole surge control tool of claim 27, wherein the fluid ejection member is fluidly coupled to a surface-located pressurized fluid source.

32. The downhole surge control tool of claim 27, wherein the fluid ejection member is one of an electrical pump and a mechanical pump.

33. The downhole surge control tool of claim 32, wherein the fluid ejection member is coupled to a surface-located operating source to operate the fluid ejection member.

34. The downhole surge control tool of claim 27, wherein the fluid ejection member is a nozzle.

35. The downhole surge control tool of claim 34, wherein the nozzle is fluidly coupled to a surface-located pressurized fluid source.

36. The downhole surge control tool of claim 27, further comprising a Venturi throat member carried by the sealing member and defining a relatively diametrically restricted opening adapted to cause a pressure drop for fluid flowing therethrough.

37. The downhole surge control tool of claim 36, wherein the expulsion opening is oriented into the relatively diametrically restricted opening of the Venturi throat member.

38. The downhole surge control tool of claim 27, further comprising a drag cage axially and slidably disposed about the body and operably connected to the sealing member to actuate the sealing member, the drag cage comprising:

a first sleeve axially and slidably disposed about the body;

a second sleeve axially and slidably disposed about the body;

a plurality of drag springs connected at one end to the first sleeve and at a another end to the second sleeve.

39. The downhole surge control tool of claim 38, wherein the collet sleeve is disposed between at least a portion of the drag cage and the body and a plurality of collet fingers are positionable in a deflected position to contact the drag cage, whereby axial movement of the drag cage in at least one direction causes a corresponding axial movement of the collet sleeve in the at least one direction while the flexible collet fingers are in the deflected position.

40. The downhole surge control tool of claim 39, further comprising a plurality of pressure actuated pistons disposed in the body, wherein each piston, when actuated, urges the flexible collet fingers into the deflected position.

41. The downhole surge control tool of claim 38, further comprising a telescoping drive member axially and slidably disposed with respect to the body and comprising a drag cage contact surface for contacting and axially driving the drag cage.

42. The downhole surge control tool of claim 41, wherein the telescoping drive member comprises a torque ring comprising a plurality of torque keys disposed in respective grooves formed on the body.

43. A method of controlling surge pressure downhole, comprising:

providing a downhole surge control tool comprising a body defining a bore and a valve disposed in the bore and positionable in (i) a closed position to seal the bore and at least restrict fluid flow therethrough and (ii) an open position to unseal the bore;

while the valve is in the closed position:

flowing a motive fluid through a Venturi member to create a pressure drop;

flowing a wellbore fluid, motivated by the pressure drop, through a fluid bypass path formed in the surge control tool.

44. The method of claim 43, wherein the motive fluid is pressurized by a surface-located fluid source.

45. The method of claim 43, further comprising, while the valve is in the closed position, expelling the wellbore fluid through an exhaust port formed in the surge control tool.

46. The method of claim 45, further comprising actuating a sealing member to seal the exhaust port while actuating the valve into the open position.

47. The method of claim 45, further comprising actuating, with the motive fluid, a plurality of pressure actuated pistons into contact with a plurality of collet fingers of a collet sleeve, whereby the plurality of collet fingers are deflected.

48. The method of claim 47, further comprising axially actuating a drive cylinder into contact with the deflected plurality of collet fingers and axially driving the collet sleeve with respect to the body.

49. The method of claim 48, wherein the collet sleeve is connected to a sealing member and wherein axially driving the collet sleeve causes actuation of the sealing member to seal an exhaust port.

50. The method of claim 49, wherein actuation of the sealing member causes simultaneous actuation of the valve.

51. The method of claim 45, further comprising actuating a sealing member to seal the exhaust port.

52. The method of claim 51, wherein actuating a sealing member comprises pulling the tool in tension while a drag cage of the tool is frictionally engaged with a wellbore casing.

53. The method of claim 52, further comprising, as a result of pulling the tool in tension:

axially moving the body relative to the drag cage;

engaging the drag cage with a sleeve axially and slidably disposed relative to the body, wherein the sleeve is operably connected to the sealing member; and axially driving, with the drag cage, the sleeve in one direction.

54. A downhole surge control tool defining an exhaust port for venting fluid, comprising:

a body having (i) a first opening at a first end, (ii) a second opening at a second end and (iii) defining a bore traversing the tool to fluidly couple the first opening and the second opening;

a wellbore fluid bypass path defined between the first opening and the exhaust port;

a fluid motivator to motivate fluid flow through the bypass fluid path and out through the exhaust port; and a valve disposed in the bore and positionable in at least (i) a closed position to at least restrict fluid flow between the first opening and the second opening via the bore and (ii) an open position to allow fluid flow between the first opening and the second opening via the bore.

55. The downhole surge control tool of claim 54, wherein the fluid motivator comprises ejection member forming an expulsion opening oriented into at least a portion of the bypass fluid path, whereby fluid expelled from fluid ejection member motivates fluid flow through the bypass fluid path.

56. The downhole surge control tool of claim 55, the fluid ejection member is a Venturi jet.

57. A method of controlling surge pressure downhole, comprising:

providing a downhole surge control tool defining an exhaust port for venting fluid, comprising:

a body having (i) a first opening at a first end, (ii) a second opening at a second end and (iii) defining a bore, a wellbore fluid bypass path defined between the first opening and the exhaust port, and a fluid motivator to motivate fluid flow through the bypass fluid path and out through the exhaust port; and flowing a motive fluid through the fluid motivator to create a pressure drop while running the tool into a pre-drilled wellbore with a string of liner, thereby motivating a wellbore fluid to flow through the bypass path.

* * * * *

UNITED STATES PATENT AND TRADEMARK OFFICE

CERTIFICATE OF CORRECTION

PATENT NO. : 7,069,991 B2
APPLICATION NO. : 10/339367
DATED : July 4, 2006
INVENTOR(S) : Gudmestad et al.

It is certified that error appears in the above-identified patent and that said Letters Patent is hereby corrected as shown below:

In the Drawings

Please replace drawing sheet 15 with replacement drawing sheet (copy attached).

In the Claims

Column 12, Claim 8, Line 46: Change “7” to --4--

Column 15, Claim 43, Line 44: After “drop;”, insert --and--

Signed and Sealed this

Sixth Day of March, 2007

JON W. DUDAS
*Director of the United States Patent and Trademark Office*